US011603691B2

(12) United States Patent
Kochanowski

(10) Patent No.: US 11,603,691 B2
(45) Date of Patent: Mar. 14, 2023

(54) DOOR ASSEMBLY FOR FREIGHT CONTAINER

(71) Applicant: George E. Kochanowski, Springboro, OH (US)

(72) Inventor: George E. Kochanowski, Springboro, OH (US)

( * ) Notice: Subject to any disclaimer, the term of this patent is extended or adjusted under 35 U.S.C. 154(b) by 80 days.

(21) Appl. No.: 17/035,962

(22) Filed: Sep. 29, 2020

(65) Prior Publication Data

US 2021/0010306 A1 Jan. 14, 2021

Related U.S. Application Data

(60) Division of application No. 15/997,887, filed on Jun. 5, 2018, now Pat. No. 10,787,848, which is a continuation of application No. 14/953,901, filed on Nov. 30, 2015, now Pat. No. 9,988,209, which is a continuation of application No. 14/238,881, filed as (Continued)

(51) Int. Cl.

| | |
|---|---|
| ***E05D 11/10*** | (2006.01) |
| ***E05D 3/08*** | (2006.01) |
| ***E05D 3/12*** | (2006.01) |
| ***E05D 3/06*** | (2006.01) |
| *B65D 88/12* | (2006.01) |

(Continued)

(52) U.S. Cl.

CPC ..... *E05D 11/1007* (2013.01); *E05D 3/06* (2013.01); *E05D 3/08* (2013.01); *E05D 3/12* (2013.01); *B65D 88/121* (2013.01); *B65D 90/008* (2013.01); *E05B 83/10* (2013.01); *E05D 3/127* (2013.01); *E05Y 2900/51* (2013.01); *E05Y 2900/516* (2013.01); *E05Y 2900/604* (2013.01)

(58) Field of Classification Search

None

See application file for complete search history.

(56) References Cited

U.S. PATENT DOCUMENTS

| | | | |
|---|---|---|---|
| 1,377,382 | A | 5/1921 | Wyman |
| 1,609,259 | A | 11/1926 | Macnider et al. |

(Continued)

FOREIGN PATENT DOCUMENTS

| | | |
|---|---|---|
| DE | 10141791 | 3/2003 |
| DE | 202009004012 | 9/2010 |

(Continued)

OTHER PUBLICATIONS

Priyo, "Maximizing Space," Innovation, Issue 10, Sep. 2008, 7 pp.

(Continued)

*Primary Examiner* — Mollie Impink

(74) *Attorney, Agent, or Firm* — Brooks, Cameron & Huebsch, PLLC

(57) ABSTRACT

The present disclosure provides a hinge, a freight container that includes the hinge and a freight container that includes a locking rod and optionally the hinge. The hinge includes a locking pin, a first wing, a second wing and a first hinge pin that pivotally connects the first wing to the second wing. The hinge further includes a pair of hinge lugs each having a first set of surfaces defining openings through which a second hinge pin passes and at least one of the pair of hinge lugs having a surface defining an opening through which a locking pin reversibly travels.

7 Claims, 12 Drawing Sheets

Related U.S. Application Data application No. PCT/US2012/050682 on Aug. 14, 2012, now Pat. No. 9,199,788.

(60) Provisional application No. 61/575,199, filed on Aug. 15, 2011.

(51) Int. Cl.
*E05B 83/10* (2014.01)
*B65D 90/00* (2006.01)

(56) References Cited

U.S. PATENT DOCUMENTS

| | | | | |
|---|---|---|---|---|
| 1,686,222 | A | | 10/1928 | Adler |
| 2,142,305 | A | | 1/1939 | Davis |
| 2,232,346 | A | | 2/1941 | Sikes |
| 2,361,743 | A | | 10/1944 | Butler |
| 2,741,391 | A | | 4/1956 | Belanger |
| 2,761,581 | A | | 9/1956 | Cohee |
| 2,868,407 | A | | 1/1959 | Woodcock |
| 3,004,682 | A | | 10/1961 | Bertolini et al. |
| 3,078,957 | A | | 2/1963 | Larson |
| 3,128,897 | A | | 4/1964 | Wilkins |
| 3,398,850 | A | | 8/1968 | Kennard |
| 3,403,806 | A | | 10/1968 | Pohl |
| 3,410,328 | A | | 11/1968 | Sasai |
| 3,480,174 | A | | 11/1969 | Sherwood |
| 3,570,698 | A | | 3/1971 | Dougherty |
| 3,612,330 | A | | 10/1971 | Baer |
| 3,612,338 | A | | 10/1971 | Ekman |
| 3,684,122 | A | | 8/1972 | Bonomi |
| 3,752,349 | A | | 8/1973 | Rana |
| 3,765,556 | A | | 10/1973 | Baer |
| 3,907,147 | A | | 9/1975 | Goobeck |
| 3,937,363 | A | | 2/1976 | Anderson |
| 4,112,635 | A | | 9/1978 | Rylander |
| 4,122,638 | A | | 10/1978 | O'Brian et al. |
| 4,191,419 | A | | 3/1980 | Kirkpatrick |
| 4,214,669 | A | | 7/1980 | McQuiston |
| 4,577,772 | A | | 3/1986 | Bigliardi |
| 4,793,507 | A | | 12/1988 | Delplanque |
| 5,107,639 | A | | 4/1992 | Morin et al. |
| 5,110,164 | A | * | 5/1992 | Whiteman ..... E05B 83/10 292/7 |
| 5,190,179 | A | | 3/1993 | Richter et al. |
| 5,257,830 | A | | 11/1993 | Pflueger |
| 5,501,353 | A | | 3/1996 | Warren |
| 5,878,903 | A | | 3/1999 | Ung |
| 5,890,612 | A | | 4/1999 | Coppi |
| 6,032,815 | A | | 3/2000 | Elstone |
| 6,108,982 | A | | 8/2000 | Davison |
| 6,109,469 | A | | 8/2000 | Clive-Smith |
| 6,112,929 | A | | 9/2000 | Ota |
| 6,164,476 | A | | 12/2000 | Rene et al. |
| 6,182,849 | B1 | | 2/2001 | Elstone, Sr. |
| 6,299,009 | B1 | | 10/2001 | Ryziuk et al. |
| 6,357,194 | B1 | | 3/2002 | Jones, Jr. |
| 7,296,704 | B2 | | 11/2007 | Ferrini |
| 7,703,632 | B2 | | 4/2010 | Kochanowski |
| 2006/0016807 | A1 | | 1/2006 | Hsu et al. |
| 2008/0029508 | A1 | | 2/2008 | Kochanowski |
| 2010/0089917 | A1 | | 4/2010 | Gilbert et al. |
| 2010/0292063 | A1 | | 11/2010 | Chawia et al. |

FOREIGN PATENT DOCUMENTS

| | | | | |
|---|---|---|---|---|
| EP | 0832825 | | 4/1998 | |
| EP | 1702864 | | 9/2006 | |
| GB | 2229423 | | 9/1990 | |
| GB | 2283528 | A * | 5/1995 | ..... E05B 83/10 |
| GB | 2450676 | | 1/2009 | |
| JP | 2002160793 | | 6/2002 | |
| JP | 2002264993 | | 9/2002 | |
| WO | 2006024104 | | 3/2006 | |
| WO | WO-2007013255 | A1 * | 2/2007 | ..... E05D 15/54 |

OTHER PUBLICATIONS

International Search Report and Written Opinion of international application No. PCT/US2012/050682, dated Jan. 23, 2014, 16 pp. http://www.gavan. com/Container_bro/Container%20parts%20Catalogue%20AU%web.pdf p. 58.

* cited by examiner

DOOR ASSEMBLY FOR FREIGHT CONTAINER

This application is a Divisional Application of U.S. application Ser. No. 15/997,887, filed Jun. 5, 2018, published as U.S. Publication No. 2019/0382193 on Dec. 19, 2019 and issued as U.S. Pat. No. 10,787,848 on Sep. 29, 2020, which is a Continuation Application of U.S. application Ser. No. 14/953,901, filed Nov. 30, 2015, published as U.S. Publication No. 2016/0075509 A1 on Mar. 17, 2016 and issued as U.S. Pat. No. 9,988,209 on Jun. 5, 2018, which is a Continuation Application having U.S. application Ser. No. 14/238,881, filed Feb. 14, 2014, published as U.S. Publication No 2014/0231422 on Aug. 21, 2014 and issued as U.S. Pat. No. 9,199,788 on Dec. 1, 2015, which is a U.S. 371 National Stage Application of International Application Number PCT/US2012/050682, filed Aug. 14, 2012 and published as WO2013/025667 on Feb. 21, 2013, which claims the benefit of U.S. Provisional Patent Application No. 61/575,199, filed Aug. 15, 2011, all of which are incorporated herein by reference in their entirety.

FIELD OF DISCLOSURE

Embodiments of the present disclosure are directed to a freight container; more specifically, embodiments are directed to a door assembly for the freight container.

BACKGROUND

Freight containers are used for transferring goods from one location to another location. Freight containers may be transferred via a number of different modes such as, overseas transfer, rail transfer, air transfer, and trailer (e.g., tractor trailer) transfer.

To help improve efficiencies freight containers have been standardized. One such standardization is overseen by the International Organization for Standardization, which may be referred to as "ISO." The ISO publishes and maintains standards for freight containers. These ISO standards for freight containers help provide that each freight container has similar physical properties. Examples of these physical properties include, but are not limited to, width, height, depth, base, maximum load, and shape of the cargo containers.

SUMMARY

One or more embodiments of the present disclosure provide a hinge having a first wing; a first hinge pin; a second wing having a first planar portion with a first end and a second end and a second planar portion that extends perpendicular from the first end of the first planar portion, where the first hinge pin pivotally connects the first wing to the second end of the first planar portion; and a pair of hinge lugs extending from the second planar portion, the hinge lugs each having a first set of surfaces defining openings through which a second hinge pin passes and at least one of the pair of hinge lugs having a surface defining an opening through which a locking pin travels.

The second planar portion of the second wing has a first major surface and a second major surface opposite the first major surface, where the pair of hinge lugs extends from the first major surface of the second planar portion. The first wing has a first major surface and a second major surface opposite the first major surface, and where in a first predetermined position the first wing is perpendicular to the first planar portion of the second wing and the first major surface of the first wing is directly opposite and parallel with the second major surface of the second planar portion. The first wing has a first end and a second end, and where the first hinge pin pivotally connects the first end of the first wing to the second end of the first planar portion. The second planar portion has an end that is distal to the first end of the first planar portion, and the pair of hinge lugs extending from the second planar portion has a first peripheral edge, where the end of the second planar portion and the first peripheral edge of the hinge lugs lay in a common plane.

One or more embodiments of the present disclosure further provide a freight container that includes a roof structure; a floor structure opposite the roof structure; sidewall structures between the floor structure and the roof structure, each of the sidewall structures having an exterior surface and an interior surface, where the interior surface at least partially defines a volume of the freight container; an end frame joined with the roof structure, the floor structure and the sidewall structures, where the end frame has a door sill, a door header and corner posts between the door sill and the door header; a hinge on each of the corner posts, the hinge having a first wing, a first hinge pin, and a second wing, where the first wing is fastened to the corner post, the second wing has a first planar portion with a first end and a second end and a second planar portion that extends perpendicular from the first end of the first planar portion, where the first hinge pin pivotally connects the first wing fastened to the corner post to the second end of the first planar portion; a pair of hinge lugs extending from the second planar portion, the hinge lugs each having a first set of surfaces defining openings through which a second hinge pin passes and at least one of the pair of hinge lugs having a surface defining an opening through which a locking pin travels; a pair of seating blocks fastened to the end frame to form a socket that receives and seats the second planar portion and at least a portion of the pair of hinge lugs, at least one of the pair of seating blocks having a surface defining an opening through which the locking pin travels to lock and un-lock the second wing from the corner post of the freight container; and a door joined to the pair of hinge lugs with the second hinge pin, where the door pivots on the second hinge pin relative the pair of hinge lugs when the hinge lugs are locked to the corner post of the freight container to allow the door to extend adjacent the exterior surface of the sidewall structure, and where the door and the second wing pivot on the first hinge pin when the hinge lugs are un-locked to the corner post of the freight container to allow the door to travel into the volume of the freight container and extend adjacent the interior surface of the sidewall structure.

The pair of seating blocks includes a lower seating block and an upper seating block, and the pair of hinge lugs includes a lower hinge lug and an upper hinge lug, where the lower hinge lug seats on the lower seating block and the upper seating block has the surface defining the opening through which the locking pin travels through the opening of the pair of hinge lugs to lock and un-lock the second wing from the corner post of the freight container. The lower seating block includes a first surface on which the lower hinge lug seats a second surface substantially perpendicular to the first surface, and a third surface that slopes between the first surface and the second surface, where the lower hinge lug travels along the third surface as the second wing pivots around the first hinge pin relative the first wing. The upper seating block includes a first surface, a second surface substantially perpendicular to the first surface, and a third surface that slopes between the first surface and the second surface, where the second planar portion travels along the third surface as the second wing pivots around the first hinge pin relative the first wing.

Each of the lower hinge lug and the upper hinge lug include a surface defining an opening through which the locking pin travels, and each of the lower seating block and the upper seating block include a surface defining an opening through which the locking pin travels to lock and un-lock the second wing from the corner post of the freight container. The end frame can include a locking pin travel stop to limit a travel distance of the locking pin. For the various embodiments, the locking pin has a surface defining a structure on which a tool can be used to cause the locking pin to travel. The locking pin secures the hinge perpendicular to an axis of rotation of the second hinge pin. The door can further include an axle and a wheel, where the wheel is positioned between the door and the floor structure to support and guide the door as the door travels into the volume of the freight container. The sidewall structures can include a latch, where the latch engages and releasable holds the door adjacent the interior surface of the sidewall structure.

A locking rod is mounted to the door, the locking rod having a first portion and a second portion joined to the first portion with a connection shaft, where the first portion and the second portion telescope relative the connection shaft to change a length of the locking rod. The connection shaft can have a polygonal cross-sectional shape. The locking rod has a handle and each of the first portion and the second portion of the locking rod has a cam, where the cam engages and disengages a cam keeper mounted to the end frame of the freight container as the handle turns the locking rod. The locking rod travels past the end frame and the cam keeper as the door travels into the volume of the freight container. The door can further include stops that limit the degree of travel of the locking rod.

One or more embodiments of the present disclosure further provide a freight container that includes a roof structure; a floor structure opposite the roof structure; sidewall structures between the floor structure and the roof structure, each of the sidewall structures having an exterior surface and an interior surface, where the interior surface at least partially defines a volume of the freight container, an end frame joined with the roof structure, the floor structure and the sidewall structures, the end frame having a cam keeper; a door joined to the end frame, where the door can move relative the end frame to travel into the volume of the freight container; and a locking rod mounted to the door, where the locking rod includes a cam that can move between a first predetermined position where the cam engage the cam keeper and a second predetermined position where the cam is disengaged from the cam keeper and travels past the end frame and the cam keeper as the door travels into the volume of the freight container.

The door of the freight container can include a locking rod with a handle and a cam, where the cam engages and disengages a cam keeper mounted to the end frame of the freight container as the handle turns the locking rod; and an anti-racking support extending away from a peripheral edge of the door, where the anti-racking support is directly adjacent the corner post when the cam is engaged with the cam keeper. The anti-racking support can be directly adjacent both the hinge and the corner post when the cam is engaged with the cam keeper. The anti-racking support has a first surface that is directly adjacent the second wing of the hinge and a second surface parallel to the first surface that is directly adjacent a U-channel of the corner post when the cam is engaged with the cam keeper. The door can further include an anti-racking block having a tab and a slot to releasably receive the tab, and where the freight container includes a first and a second of the door, with the tab extending from the first of the door and the slot extending from the second of the door such that the tab seats completely within the slot when the cam of each of the first of the door and the second of the door are engaged with their respective cam keeper.

The freight container can also include a roof structure, a floor structure opposite the roof structure, sidewall structures between the floor structure and the roof structure, an end frame having a corner post, the end frame joined with the roof structure, the floor structure and the sidewall structures, a door joined to the corner post with a hinge, the hinge having a locking pin, a first wing, a first hinge pin, a second hinge pin, and a second wing, where the first wing is fastened to the corner post, the second wing has a first planar portion with a first end and a second end and a second planar portion that extends perpendicular from the first end of the first planar portion, where the first hinge pin pivotally connects the first wing fastened to the corner post to the second end of the first planar portion, a pair of hinge lugs extending from the second planar portion, the hinge lugs each having a first set of surfaces defining openings through which the second hinge pin passes, where the door pivots on the second hinge pin relative the pair of hinge lugs when the hinge lugs are locked to the corner post of the freight container with the locking pin to allow the door to extend adjacent the exterior surface of the sidewall structure, and where the door and the second wing pivot on the first hinge pin when the hinge lugs are un-locked to the corner post of the freight container to allow the door to travel into the volume of the freight container and extend adjacent the interior surface of the sidewall structure, and an anti-racking support including a first lug, a second lug and a mounting support fastened to the door, where the first lug and the second lug extend from the mounting support in a common direction to extend from a peripheral edge of the door.

The hinge can also include a locking pin, a first wing, a first hinge pin, a second wing having a first planar portion with a first end and a second end and a second planar portion that extends perpendicular from the first end of the first planar portion, where the first hinge pin pivotally connects the first wing to the second end of the first planar portion, a second hinge pin, and a pair of hinge lugs extending from the second planar portion, the hinge lugs each having a first set of surfaces defining openings through which the second hinge pin passes and the first wing and the second planar portion of the second wing each include a surface that defines an opening through which the locking pin reversibly travels.

The freight container can also include a corner post having a J-bar and a U-channel, an H-Block positioned between the J-bar and the U-channel of the corner post, where edges of the U-channel abut the H-Block, and a hinge coupled to the corner post, where the use of the H-Block protects the hinge from forces transmitted through the corner post.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DETAILED DESCRIPTION

Figure 1:
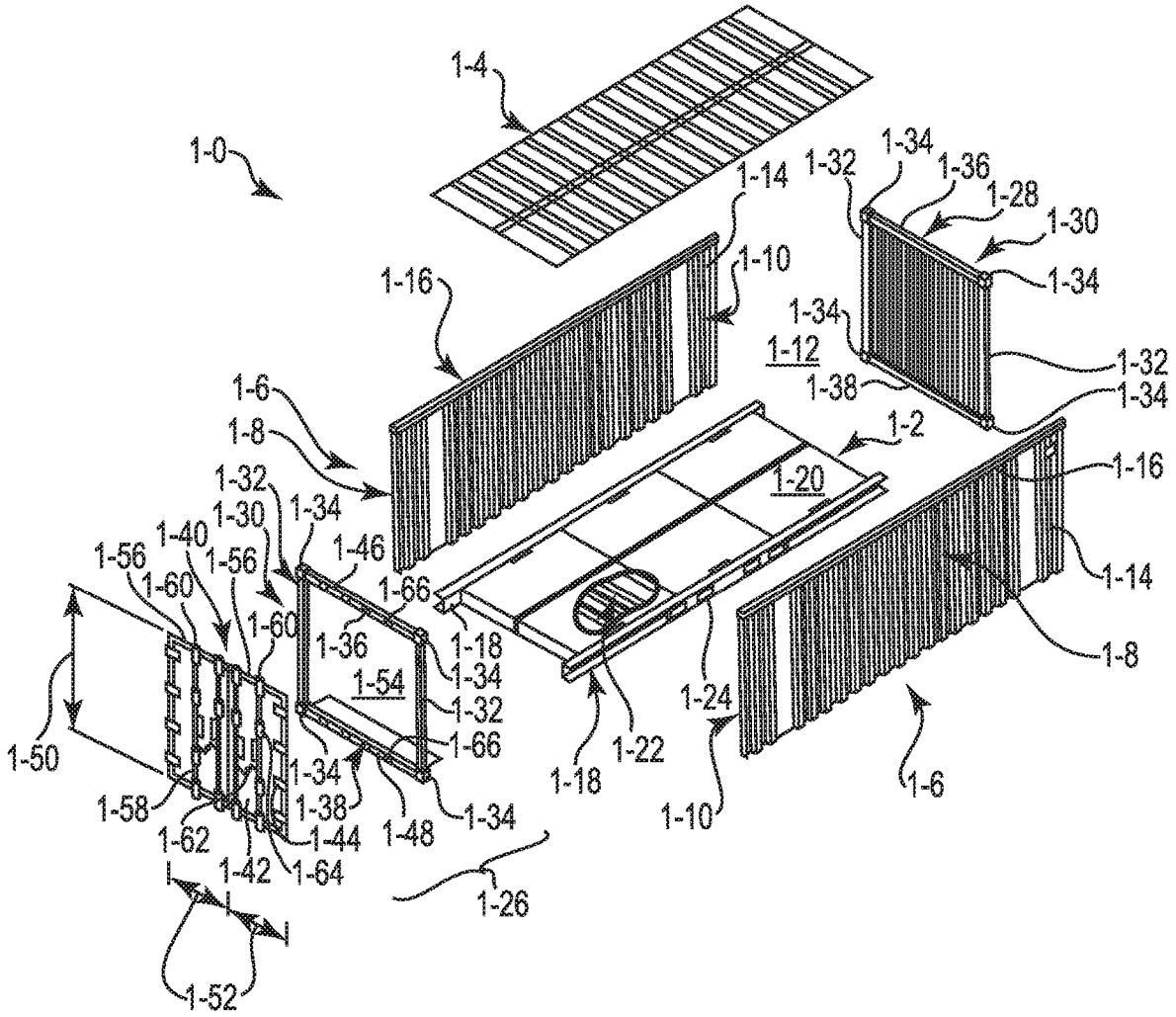
FIG. 1 provides an exploded view of a freight container according to the present disclosure.

Freight containers (also known as containers, shipping containers, intermodal containers and/or ISO containers, among other names) can be transported by rail, air, road and/or water. Freight containers are often times transported empty. Because the freight container occupies the same volume whether it contains goods or not, the cost (both financial and environmental) to transport an empty freight container can be equivalent to the cost of transporting a full freight container. For example, the same number of trucks (e.g., five) would be needed to transport the same number of empty freight containers (e.g., five). In addition, freight containers often times sit empty at storage facilities and/or transportation hubs. Regardless of where the freight container is located (in transit or in storage) the volume an empty freight container occupies is not being used to its full potential.

One solution to these issues would be a reversibly foldable freight container, as is discussed herein. Having a reversibly foldable freight container would allow for an "empty" freight container to be folded to achieve a volume that is smaller than its fully expanded state. This extra volume acquired by at least partially folding the freight container could then be used to accommodate other at least partially folded freight containers, provide additional volume for non-foldable (e.g., regular) freight containers and/or foldable freight containers in their fully expanded state. So, for example, a number of reversibly foldable freight containers that are empty (e.g., five) could be folded and nested in such a way that one truck could transport the number of empty freight containers. As a result the environmental and cost savings are expected to be significant.

As used herein, "a," "an," "the," "at least one," and "one or more" are used interchangeably. The term "and/or" means one, one or more, or all of the listed items. The recitations of numerical ranges by endpoints include all numbers subsumed within that range (e.g., 1 to 5 includes 1, 1.5, 2, 2.75, 3, 3.80, 4, 5, etc.).

The figures herein follow a numbering convention in which the first digit or digits correspond to the drawing figure number and the remaining digits identify an element in the drawing. Similar elements between different figures may be identified by the use of similar digits. For example, 3-66 may reference element "66" in FIG. 3, and a similar element may be referenced as 4-66 in FIG. 4. It is emphasized that the purpose of the figures is to illustrate and the figures are not intended to be limiting in any way. The figures herein may not be to scale and relationships of elements in the figures may be exaggerated. The figures are employed to illustrate conceptual structures and methods herein described.

FIG. 1 illustrates an exploded view of a freight container 1-0 according to one or more embodiments of the present disclosure. The freight container 1-0 includes a floor structure 1-2, a roof structure 1-4 opposite the floor structure 1-2, and a sidewall structure 1-6 that joins the floor structure 1-2 and the roof structure 1-4. Each of the sidewall structures 1-6 has an exterior surface 1-8 and an interior surface 1-10, where the interior surface 1-10 of the sidewall structures 1-6, the floor structure 1-2 and the roof structure 1-4 at least partially defines a volume 1-12 of the freight container 1-0.

The sidewall structure 1-6 includes a sidewall panel 1-14 that is joined to a top side rail 1-16 and a bottom side rail 1-18. The floor structure 1-2 includes flooring 1-20 that is attached to cross members 1-22 (in FIG. 1 a portion of the flooring 1-20 has been removed to show the cross members 1-22), where the cross members 1-22 are joined to the bottom side rail 1-18. The bottom side rail 1-18 can further include forklift pockets 1-24.

The freight container 1-0 further includes a rear wall 1-26 and a front wall 1-28. Each of the rear wall 1-26 and the front wall 1-28 include an end frame 1-30 joined with the roof structure 1-4, the floor structure 1-2 and the sidewall structures 1-6. The end frame 1-30 includes corner posts 1-32, corner fittings 1-34, a header 1-36 and a sill 1-38.

The rear wall 1-26 includes a door assembly 1-40. The door assembly 1-40 can include a door 1-42 attached to the end frame 1-30 of the rear wall 1-26 with hinges 1-44. The end frame 1-30 of the rear wall 1-26 includes the header 1-36, which is also referred to as a door header 1-46 for the door assembly 1-40, and the sill 1-38, which is also referred to as a door sill 1-48 for the door assembly 1-40. The corner posts 1-32 extend between and couple the door sill 1-48 and the door header 1-46.

FIG. 1 provides an embodiment of the door assembly 1-40 that includes two of the doors 1-42, where each door 1-42 is attached by the hinges 1-44 to corner posts 1-32. Each door 1-42 has a height 1-50 and a width 1-52 that allows the door 1-42 to fit within an area 1-54 defined by the end frame 1-30 of the rear wall 1-26. The door 1-42 can further include a gasket 1-56 around a perimeter of the door 1-42 to help provide weatherproofing on the exterior portion of the rear wall 1-26.

The door 1-42 includes a locking rod 1-58 having a cam 1-60 and a handle 1-62. The locking rod 1-58 can be mounted to the door 1-42 with a bearing bracket assembly 1-64, where the locking rod 1-58 turns within and is guided by the bearing bracket assembly 1-64 to engage and disengage the cam 1-60 and a cam keeper 1-66. The cam keeper 1-66 is mounted on the end frame 1-30, specifically the cam keeper 1-66 is mounted on the door header 1-46 and the door sill 1-48 of the end frame 1-30 of the rear wall 1-26.

The locking rod 1-58 mounted to the door 1-42 can move between a first predetermined position where the cam 1-60 is aligned with and can engage the cam keeper 1-66, as discussed above, and a second predetermined position. In the second predetermined position the cam 1-60 is disengaged from the cam keeper 1-66 and has a position relative the end frame 1-30 that allows the cam 1-60 and the door 1-42 to travel through the area 1-54, past the end frame 1-30 and the cam keeper 1-66 of the rear wall 1-26, and into the volume 1-12 of the freight container 1-0. In other words, in the second predetermined position portions of the locking rod 1-58 have been moved, as described herein, so as to position the cam 1-60 directly adjacent the surface of the door 1-42 so that the door 1-42 can be opened into the volume 1-12 of the freight container 1-0. As discussed herein, opening the door 1-42 into the volume 1-12 of the freight container 1-0 is accomplished, in addition to having the locking rod 1-58 in the second predetermined position, with the use of the hinge 1-44 of the present disclosure, as will be more fully discussed herein.

Figure 2:
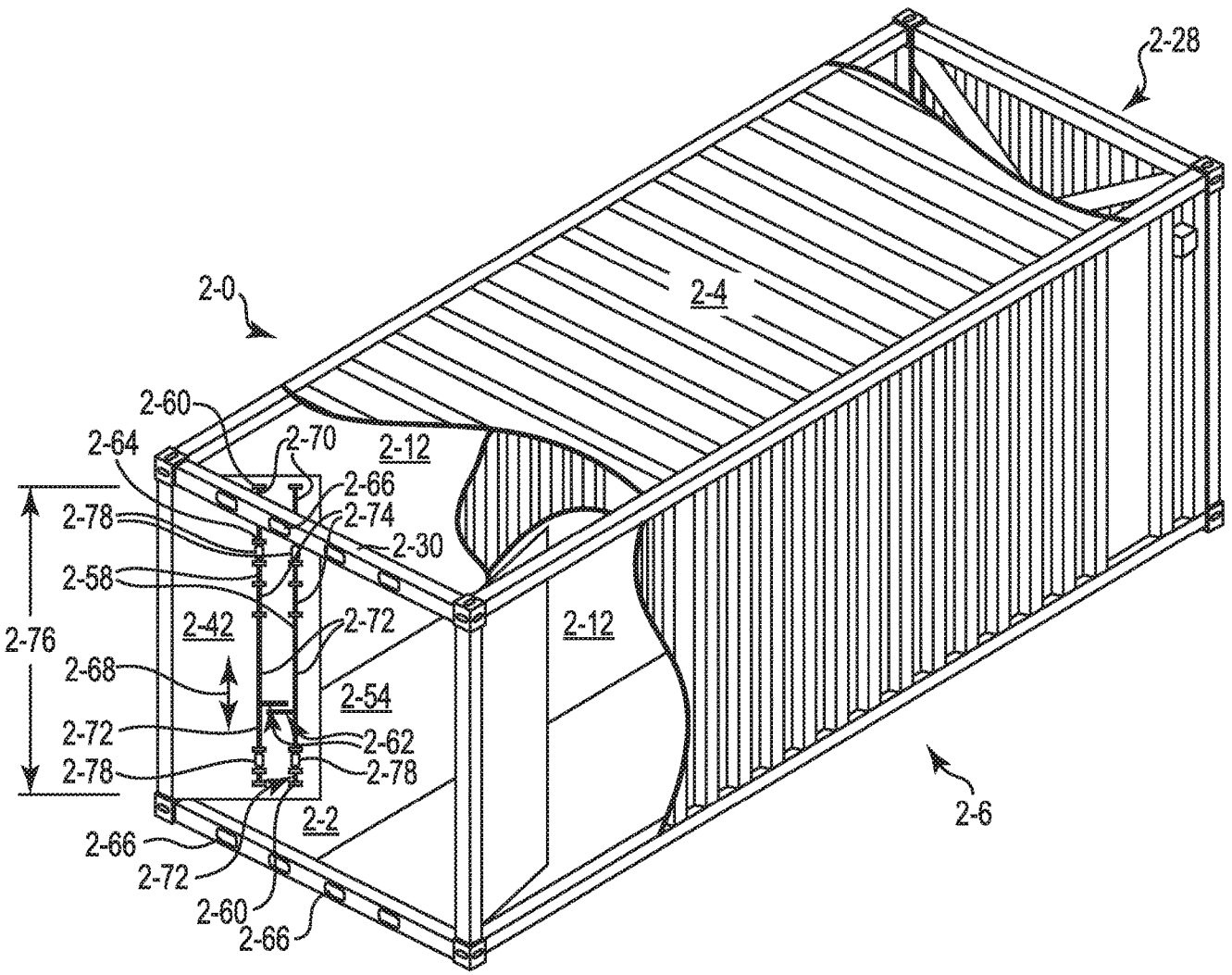
FIG. 2 provides a perspective view of a freight container according to the present disclosure.

For the various embodiments, the first predetermined position is shown in FIG. 1, where the cam 1-60 and the cam keeper 1-66 are positioned relative each other so the cam 1-60 can engage and disengage the cam keeper 1-66 positioned on the end frame 1-30. FIG. 2 provides an illustration of the cam 2-60 in at least one embodiment of the second predetermined position relative the cam keeper 2-66. As illustrated in FIG. 2, the cam 2-60 has been positioned, relative the first predetermined position, so that the cam 2-60 is no longer aligned so as to engage and/or disengage the cam keeper 2-66. The cam 2-60 is also positioned relative the end frame 2-30 such that the cam 2-60 can pass through the area 2-54 defined by the end frame 2-30 as the door 2-42 travels into the volume 2-12 of the freight container 2-0, where the volume 2-12 can be defined, at least in part, by the floor structure 2-2, the roof structure 2-4, the sidewall structure 2-6 and the rear wall 2-28 (shown with cutaways to help better illustrate the position of the doors 2-42 in the volume 2-12 defined by the freight container 2-0).

For the various embodiments, moving the cam 2-60 between the first predetermined position and the second predetermined position can be accomplished in a number of different ways. For example, the locking rod 2-58 can have two or more portions that can telescope along a longitudinal axis 2-68 of the locking rod 2-58. The locking rod 2-58 can include a first portion 2-70 and a second portion 2-72 joined to the first portion 2-70 with a connection shaft 2-74. The first portion 2-70 and the second portion 2-72 can telescope relative the connection shaft 2-74 to change a length 2-76 of the locking rod 2-58.

For example, the first portion 2-70 and the second portion 2-72 can travel along the connection shaft 2-74 between the first predetermined position and the second predetermined position. As illustrated, the connection shaft 2-74 can be held in place on the door 2-42 with a combination of the bearing bracket assembly 2-64 and an anti-rack ring 2-78. For the various embodiments, the anti-rack ring 2-78 can be joined to the connection shaft 2-74 on either end of the bearing bracket assembly 2-64 such that the shaft 2-74 can rotate in the bearing bracket assembly 2-64 by turning handle 2-62, but will not pass vertically, relative the floor structure 2-2 and/or the roof structure 2-4, through the bearing bracket assembly 2-64 (e.g., the connection shaft 2-74 will not move up and/or down relative the bearing bracket assembly 2-64) due to the presences of the anti-rack ring 2-78.

Figure 3A:
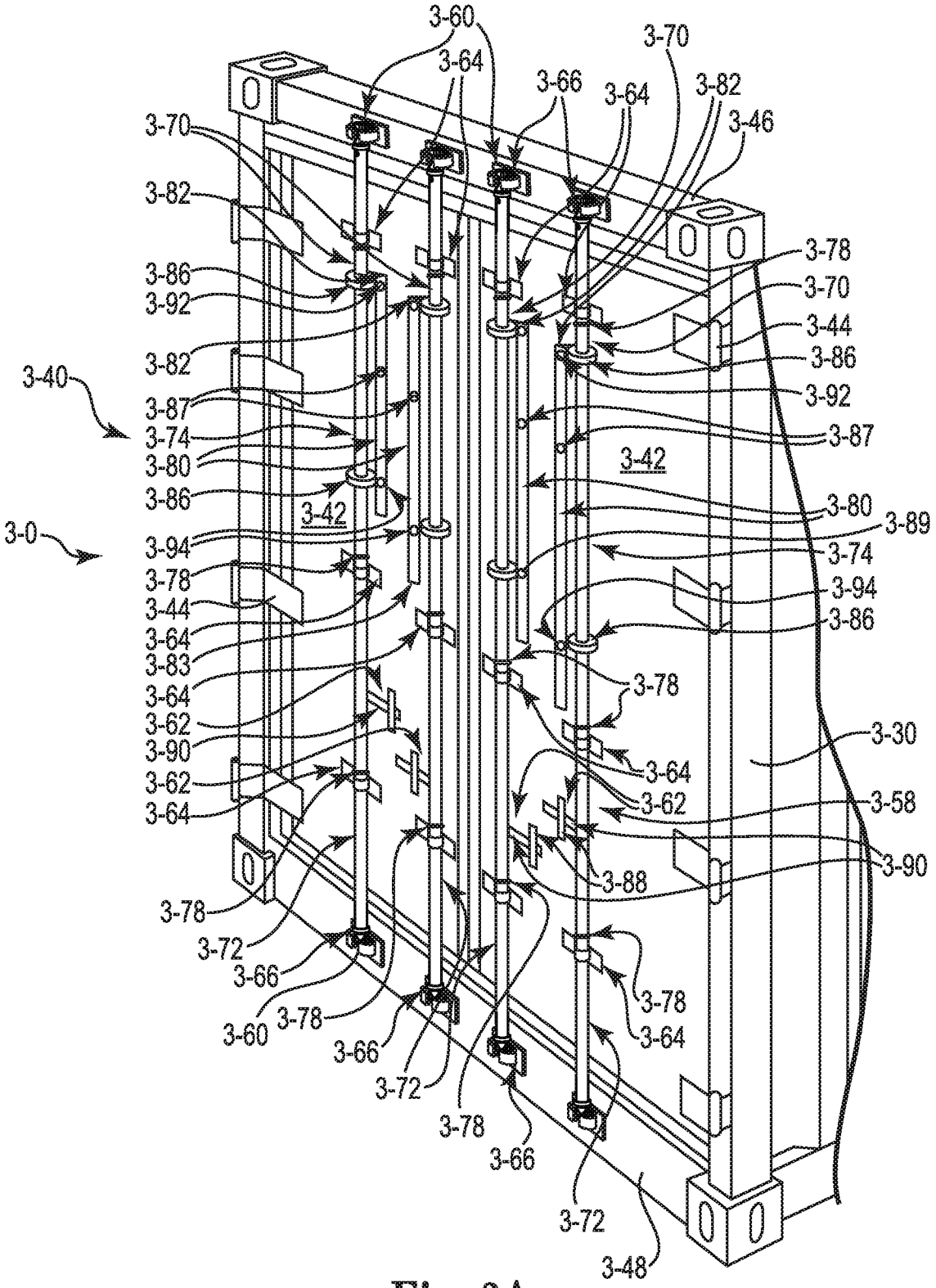
FIGS. 3A and 3B provide a perspective view of a door assembly with locking rods in the first predetermined position with cams of the locking rods engaged with the cam keepers (FIG. 3A) and the second predetermined position with cams of the locking rods disengaged with the cam keepers (FIG. 3B) according to the present disclosure.
Figure 3B:
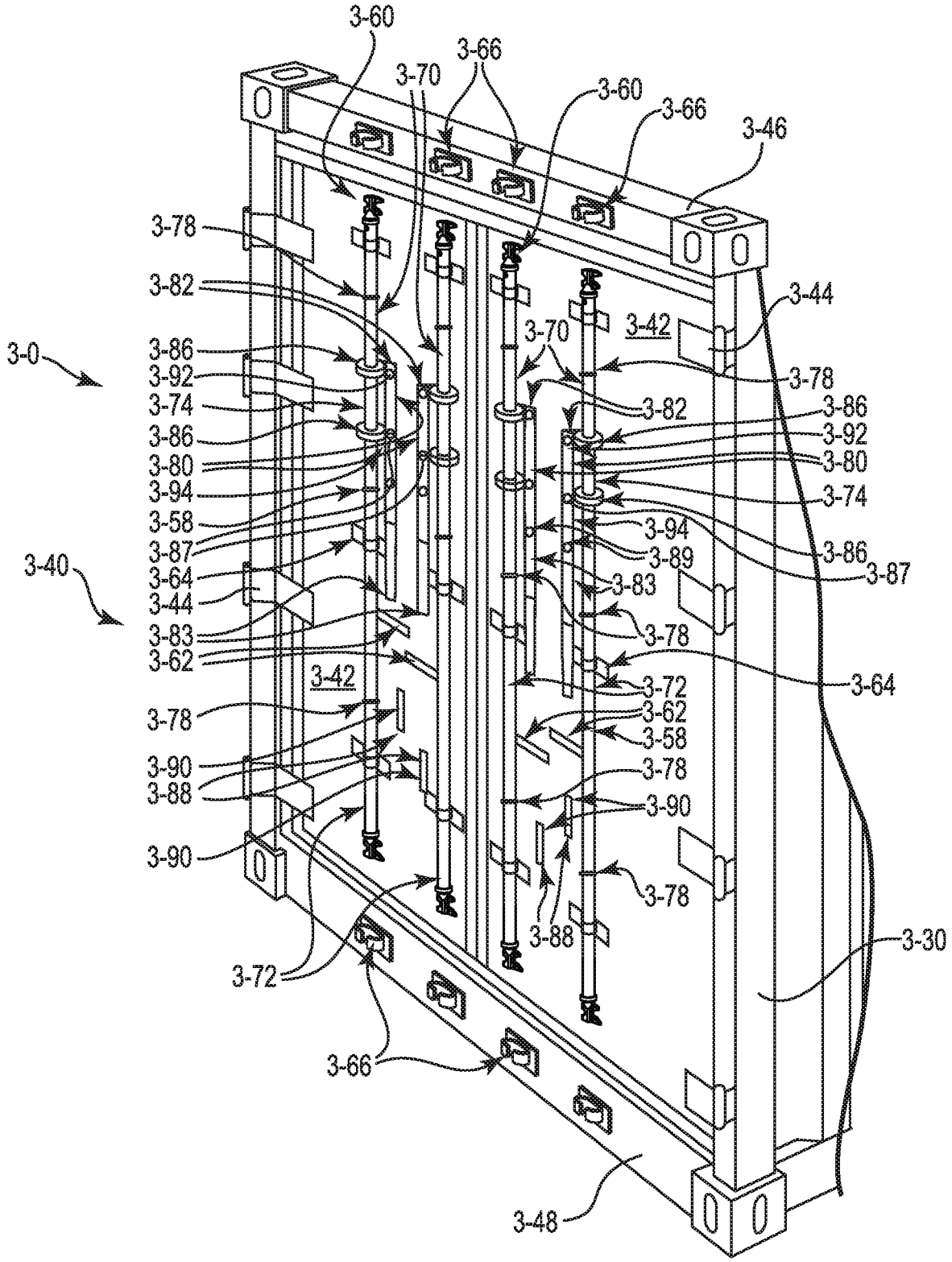

Referring now to FIGS. 3A and 3B there is shown the door assembly 3-40 with the locking rods 3-58 in the first predetermined position (e.g., the cam 3-60 aligned with and can engage the cam keeper 3-66 as illustrated in FIG. 3A) and the second predetermined position (e.g., the cam 3-60 disengaged from the cam keeper 3-66 and has a position relative the end frame 3-30 that allows the cam 3-60 and the door 3-42 to travel into the volume of the freight container 300 as illustrated in FIG. 3B). As illustrated, the door assembly 3-40 includes doors 3-42, hinges 3-44, door header 3-46, door sill 3-48, locking rod 3-58, cam 3-60, handle 3-62, bearing bracket assembly 3-64 and cam keeper 3-66, as discussed herein. The embodiments illustrated in FIGS. 3A and 3B also include each of the first portion 3-70 and the second portion 3-72, where each of the portions 3-70 and 3-72 include a socket 3-86 for receiving at least a portion of the connection shaft 3-74. For the various embodiments, it is along and through the socket 3-86 that each of the first portion 3-70 and the second portion 3-72 can travel relative the connection shaft 3-74 as the locking rod 3-58 telescopes to change the length of the locking rod 3-58 between the first predetermined position as illustrated in FIG. 3A and the second predetermined position as illustrated in FIG. 3B.

For the various embodiments, the socket 3-86 and the connection shaft 3-74 can have a cross-sectional shape that does not allow the connection shaft 3-74, the first portion 3-70 and/or the second portion 3-72 to rotate relative to each other to any significant degree. Such cross-sectional shapes can include, but are not limited to, non-circular cross sectional shapes such as oval, elliptical, or polygonal, such as triangular, square, rectangular, or higher polynomial such as pentagonal, hexagonal, etc. For the various embodiments, the connection shaft 3-74 can further include a bearing bracket assembly, as discussed herein, in which to rotate and to provide support for the connection shaft 3-74 in its position relative the first and second portions 3-70 and 3-72. For the various embodiments, it is possible that the socket 3-86 may also include a bushing positioned between the connection shaft 3-74 and each of the first and second portions 3-70 and 3-72. For the various embodiments, the bushing can be made of a polymer, such as polytetrafluoroethylene.

For the various embodiments, the first portion 3-70 and the second portion 3-72 can be mounted to the door 3-42 with a combination of the bearing bracket assembly 3-64 and the anti-rack ring 3-78. For example, each of the first portion 3-70 and the second portion 3-72 can have bearing bracket assembly 3-64 and anti-racking ring 3-78 joined to each portion 3-70 and 3-72 that allows the portions 3-70 and 3-72 to rotate in the bearing bracket assembly 3-64 by turning the handle 3-62. For the various embodiments, the second portion 3-72 can include the handle 3-62. For the various embodiments, the door 3-42 further includes a retainer plate 3-88 and a retainer catch 3-90 to receive and releasably hold the handle 3-62 against the door 3-42.

As illustrated, the anti-racking ring 3-78 on each of the first portion 3-70 and the second portion 3-72 of the locking rod 3-58 is positioned between the bearing bracket assembly 3-64 for the connection shaft 3-74 and the bearing bracket assembly 3-64 for the respective portion 3-70 and 3-72. This configuration allows each of the first portion 3-70 and/or the second portion 3-72 to telescope, relative the floor structure and roof structure, between the first predetermined position (FIG. 3A) and the second predetermined position (FIG. 3B), discussed herein. For the various embodiments, the anti-racking rings 3-78 can also act as stops that limit the degree of travel of the first and second portions 3-70 and 3-72 of the locking rod 3-58.

The locking rod 3-58 can also include an adjustment member 3-80 that can releasably join the first portion 3-70 and the second portion 3-72 of the locking rod 3-58. For the various embodiments, the adjustment member 3-80 includes a first end 3-82 and a second end 3-83, with surfaces defining a first opening 3-87 adjacent the first end 3-82 and a second opening 3-89 between the first opening 3-87 and the second end 3-83 of the adjustment member 3-80. For the various embodiments, the adjustment member 3-80 can be non-releasably, but pivotally, attached to the first portion 3-70 at or adjacent the first end 3-82. For the various embodiments, the first and second openings 3-87 and 3-89 can then be used to releasably couple the first and second portions 3-70 and 3-72 of the locking rod 3-58 in either one of the first predetermined position (seen in FIG. 3A) and/or the second predetermined position (seen in FIG. 3B).

The adjustment member 3-80 can be a forged metal bar that is non-releasably, but pivotally, attached by a hub mount bracket 3-92 to the first portion 3-70. The adjustment member 3-80 can also be a cast or machined metal bar that is non-releasably, but pivotally, attached by a hub mount bracket 3-92 to the first portion 3-70. A rivet can be used to couple the adjustment member 3-80 to the hub mount bracket 3-92. The second portion 3-72 can also include a mounting bracket 3-94 that can receive and releasably couple the adjustment member 3-80. The mounting bracket 3-94 can include a pin or a shaft over which either one of the first opening 3-87 or the second opening 3-89 on the adjustment member 3-80 can be positioned. For the various embodiments, the pin or shaft on the mounting bracket 3-94 can have a surface that defines an opening through the pin or shaft. The opening through the pin or shaft can be located such that when either one of the first opening 3-87 or the second opening 3-89 is positioned over the pin or shaft the opening can releasably receive an R-pin or R-clip. Once in position, the R-pin or R-clip can hold the adjustment member 3-80 so as to keep the locking rod 3-58 rigid (e.g., rigid along the longitudinal axis of the locking rod 3-58). The locking rod 3-58 in its first predetermined position can perform an anti-racking function, as is known in the art. As appreciated, other structures besides R-pins or R-clips can be used to releasably secure the adjustment member 3-80 between the first portion 3-70 and the second portion 3-72.

The adjustment member 3-80 can also be used to telescope (e.g., move) the first portion 3-70 of the locking rod 3-58 between the first predetermined position and the second predetermined position. Similarly, the handle 3-62 can be used to telescope (e.g., move) the second portion 3-72 of the locking rod 3-58 between the first predetermined position and the second predetermined position.

Figure 4:
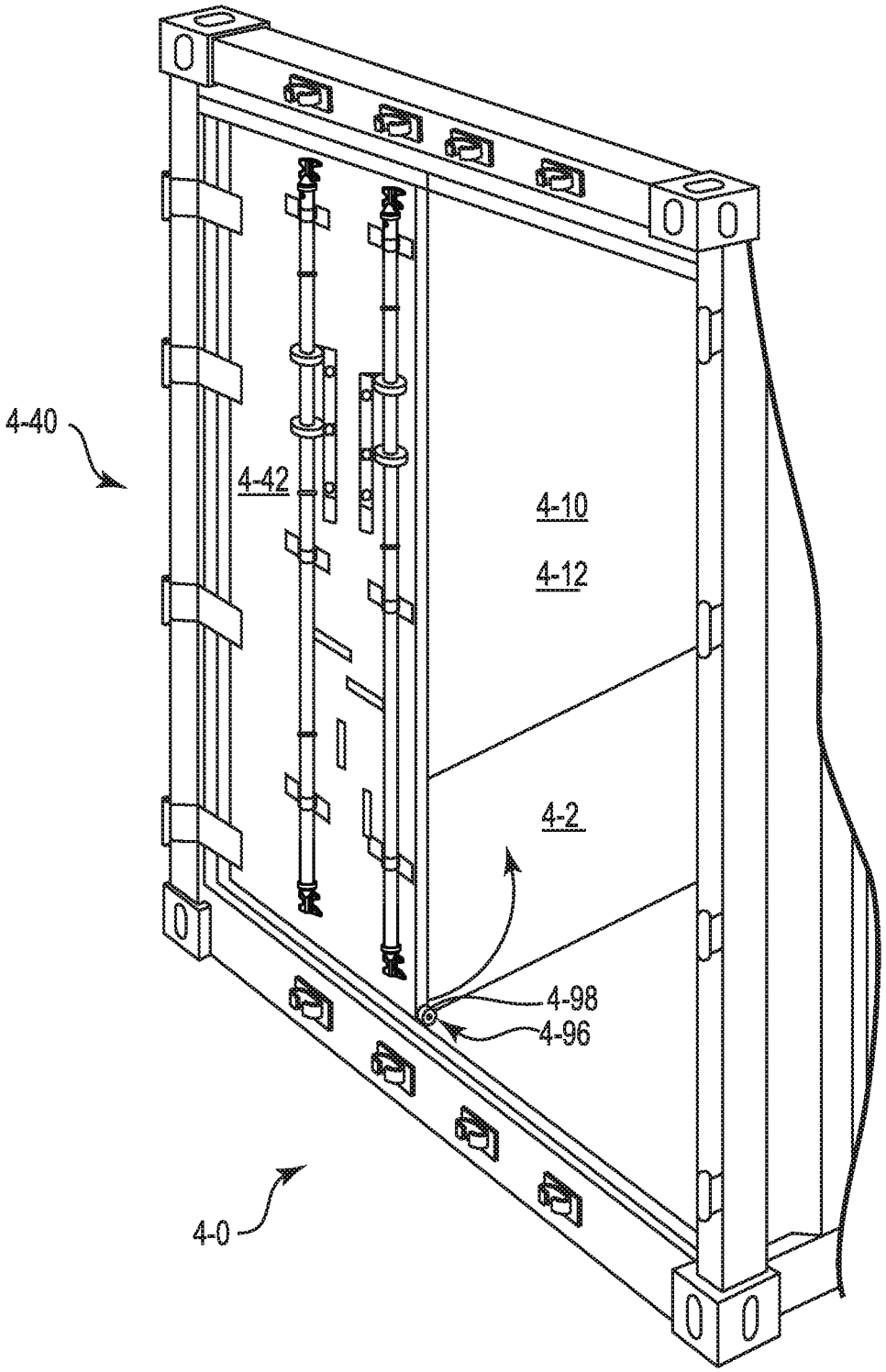
FIG. 4 provides a perspective view of the door assembly according to the present disclosure.

Referring now to FIG. 4, there is shown an embodiment of the door assembly 4-40 of the present disclosure. As illustrated, only one door 4-42 is shown so as to better illustrate the following embodiment. The door assembly 4-40 includes the components as discussed herein for FIGS. 1 through 3B. For the various embodiments, the door 4-42 illustrated in FIG. 4 further includes a wheel 4-96 positioned between the door 4-42 and the floor structure 4-2. For the various embodiments, more than one wheel 4-96 can be used with the door 4-42 (e.g., two of wheel 4-96, three of wheel 4-96, etc. could be used with the door 4-42).

The wheel 4-96 can help to support the weight of and guide the door 4-42 as it travels into the volume 4-12 of the freight container 4-0. The wheel 4-96 includes an axle 4-98 on which the wheel 4-96 rotates. The axle 4-98 can be fixed to the wheel 4-96 where the axle 4-98 is supported by and rotates on a bracket housed within the door 4-42 structure. Alternatively, the axle 4-98 can be fixed to the door 4-42, where the wheel 4-96 includes a bearing or bushing that allows the wheel 4-96 to rotate around the axle 4-98.

Figure 5:
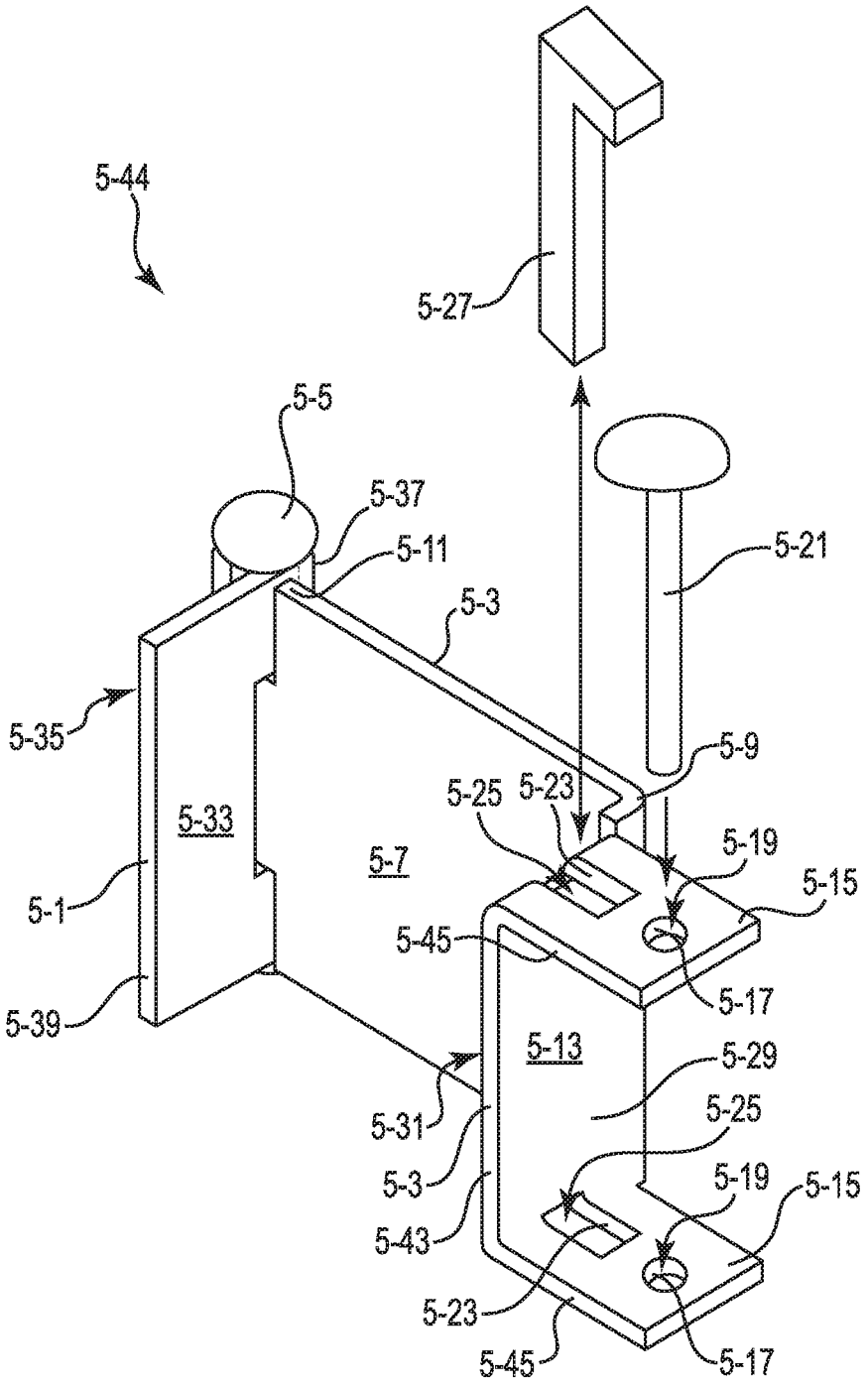
FIG. 5 provides a perspective view of a hinge according to the present disclosure.

Referring now to FIG. 5, there is shown an embodiment of the hinge 5-44 according to the various embodiments of the present disclosure. As illustrated, the hinge 5-44 includes a first wing 5-1 and a second wing 5-3, where the first wing 5-1 and the second wing 5-3 are pivotally connected by a first hinge pin 5-5. For the various embodiments, the second wing 5-3 includes a first planar portion 5-7 with a first end 5-9 and a second end 5-11 and a second planar portion 5-13 that extends perpendicular from the first end 5-9 of the first planar portion 5-7. The first hinge pin 5-5 pivotally connects the first wing 5-1 to the second end 5-11 of the first planar portion 5-7. As illustrated, a portion of the first planar portion 5-7 of the second wing 5-3 passes through an opening defined in the first wing 5-1 so as to allow the second end 5-11 of the first planar portion 5-7 of the second wing 5-3 to pivotally connect to the first hinge pin 5-5 and the first wing 5-1.

The hinge 5-44 also includes a pair of hinge lugs 5-15 that extend from the second planar portion 5-13 of the second wing 5-3. Each of the hinge lugs 5-15 has a first set of surfaces 5-17 defining openings 5-19 through which a second hinge pin 5-21 passes. For the various embodiments, at least one of the pair of hinge lugs 5-15 has a surface 5-23 defining an opening 5-25 through which a locking pin 5-27 travels. The locking pin 5-27 can reversibly travel through the opening 5-25, where in a first position with the locking pin 5-27 positioned completely outside the opening 5-25 the second wing 5-3 is unlocked relative the first wing 5-1, and when the locking pin 5-27 is at least partially, or completely, positioned through the opening 5-25 the second wing 5-3 is locked relative the first wing 5-1.

The second planar portion 5-13 of the second wing 5-3 includes a first major surface 5-29 and a second major surface 5-31 opposite the first major surface 5-29. The pair of hinge lugs 5-15 extends from the first major surface 5-29 of the second planar portion 5-13. The first wing 5-1 has a first major surface 5-33 and a second major surface 5-35 opposite the first major surface 5-33. In a first predetermined position the first wing 5-1 is perpendicular to the first planar portion 5-7 of the second wing 5-3 and the first major surface 5-33 of the first wing 5-1 is directly opposite and parallel with the second major surface 5-31 of the second planar portion 5-13. As will be discussed more fully herein, the first predetermined position can occur with the first wing 5-1 attached to a corner post of the freight container and the second wing 5-3 of the hinge 5-44 is positioned against (e.g., adjacent to and in at least partial contact with) the corner post.

The first wing 5-1 has a first end 5-37 and a second end 5-39, and where the first hinge pin 5-5 pivotally connects the first end 5-37 of the first wing 5-1 to the second end 5-11 of the first planar portion 5-7 of the second wing 5-3. The second planar portion 5-13 has an end 5-43 that is distal to the first end 5-9 of the first planar portion 5-7 and the pair of hinge lugs 5-15 extending from the second planar portion 5-13 have a first peripheral edge 5-45, where the end 5-43 of the second planar portion 5-13 and the first peripheral edge 5-45 of the hinge lugs 5-15 lay in a common plane.

Figure 6:
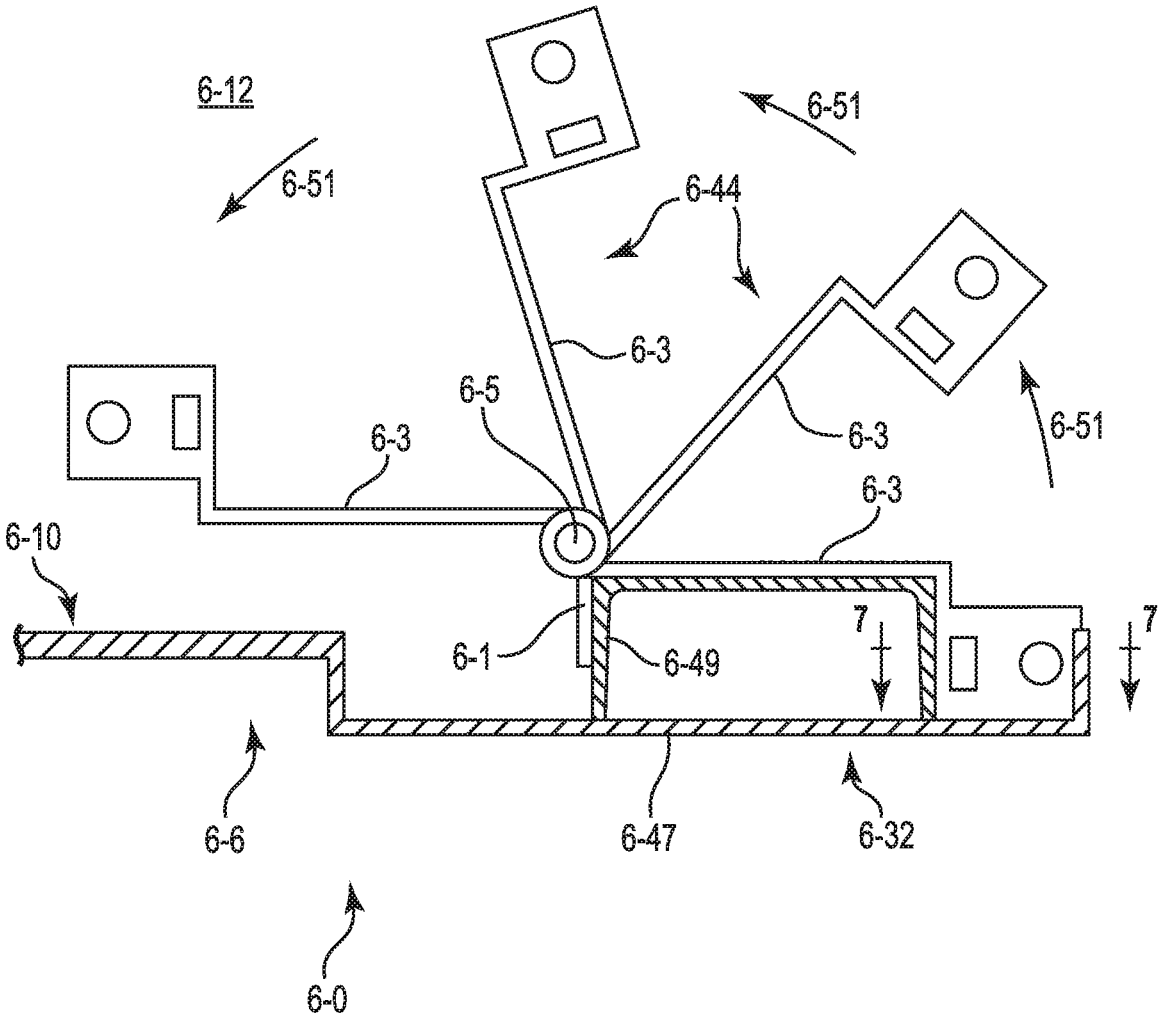
FIG. 6 provides a planar view of the hinge fastened to a corner post of a freight container according to the present disclosure.

Referring now to FIG. 6, there is shown a top down view of the hinge 6-44 according to the present disclosure that has been mounted on a corner post 6-32 of a freight container 6-0. For the various embodiments, only a portion of the freight container 6-0 is illustrated in FIG. 6 to allow for a better view and understanding of the operation of the hinge 6-44. For the various embodiments, the corner post 6-32 of the freight container 6-0 is formed from a "J" bar 6-47 and a "U"-channel 6-49, where the J-bar 6-47 and the U-channel 6-49 are welded together to form the corner post 6-32 of the freight container 6-0. A "U"-channel 6-49 is also known as an "inner post."

As illustrated, the first wing 6-1 is fastened to a portion of the U channel 6-49. The first wing 6-1 can be fastened to the portion of the U channel by a welding (e.g., arc-welding) process. The second wing 6-3 (illustrated in multiple positions in FIG. 6 as the second wing 6-3 pivots about the first hinge pin 6-5) is free to pivot around the first hinge pin 6-5. The travel path 6-51 of the second wing 6-3 shown in FIG. 6 is into the volume 6-12 of the freight container 6-0 (as partially defined by the interior surface 6-10 of the side wall structure 6-6 of the freight container 6-0).

Figure 7:
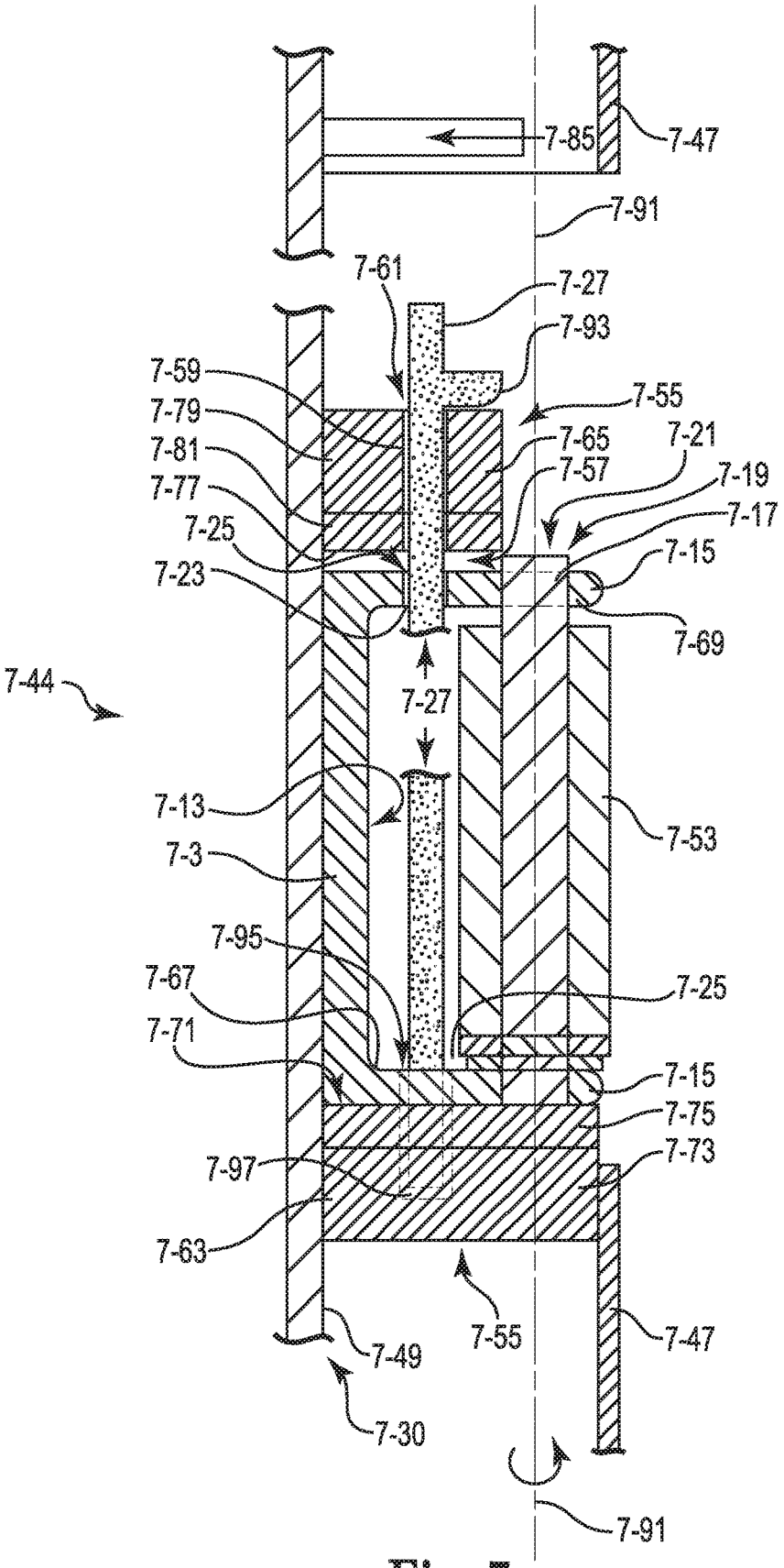
FIG. 7 provides a planar view of the hinge fastened to a corner post of a freight container according to the present disclosure.

Referring now to FIG. 7, there is shown the hinge 7-44 in the first predetermined position (as illustrated in FIG. 5) on the freight container 7-0 as viewed along lines 7-7 in FIG. 6. The embodiment illustrated in FIG. 7 also includes the locking pin 7-27 and the second hinge pin 7-21 as illustrated in FIG. 5. As illustrated, the second wing 7-3 includes hinge lugs 7-15 that extend from the second planar portion 7-13, and which hinge lugs 7-15 include the first set of surfaces 7-17 defining openings 7-19 through which the second hinge pin 7-21 passes and is seated. As will be discussed more fully herein, the door of the fright container pivots (e.g., swings) about second hinge pin 7-21. The hinge lugs 7-15 also include the surface 7-23 defining the opening 7-25 through which the locking pin 7-27 travels.

FIG. 7 also shows the hinge 7-44 having a pair of seating blocks 7-55 fastened to the end frame 7-30 (only a portion of which is shown) of the container to form a socket 7-57 that receives and seats the second planar portion 7-13 and at least a portion of the pair of hinge lugs 7-15. As illustrated, the U-channel 749 of end frame 7-30 helps to form a portion of the socket 7-57. A portion of the J-bar 7-47 is removed so as to create a volume into which the second wing 7-3 can reside and so as to allow the hinge 7-44 to pivot such that door can swing towards the exterior surface of the sidewall structure (a feature that is more fully illustrated and discussed herein). At least one of the pair of seating blocks 7-55 has a surface 7-59 defining an opening 7-61 through which the locking pin 7-27 travels to lock and un-lock the second wing 7-3 from the corner post of the freight container. As discussed herein, the locking pin 7-27 reversibly travels to lock and un-lock the second wing 7-3 from the corner post of the freight container.

The door is joined to the pair of hinge lugs 7-15, as illustrated herein, with the second hinge pin 7-21 where the door pivots on the second hinge pin 7-21 relative the pair of hinge lugs 7-15 when the hinge lugs 7-15 are locked to the corner post of the freight container. This allows the door to extend adjacent the exterior surface of the sidewall structure. In addition, the door and the second wing 7-3 can pivot on the first hinge pin when the hinge lugs 7-15 are un-locked to the corner post of the freight container to allow the door to travel into the volume of the freight container and extend adjacent the interior surface of the sidewall structure. These embodiments will be illustrated and further discussed herein.

The pair of seating blocks 7-55 can include a lower seating block 7-63 and an upper seating block 7-65. The pair of hinge lugs 7-15 includes a lower hinge lug 7-67 and an upper hinge lug 7-69. The lower hinge lug 7-67 can releasably seat, or rest, on the lower seating block 7-63. The upper seating block 7-65 can have the surface 7-59 defining the opening 7-61 through which the locking pin 7-27 travels through the opening 7-25 of the hinge lug 7-69 to lock and un-lock the second wing 7-3 from the corner post of the freight container. The lower hinge lug 7-67 can also include a surface 7-95 defining an opening 7-97 through which the locking pin 7-27 travels. Each of the lower seating block 7-63 and the upper seating block 7-65 also include a surface defining an opening through which the locking pin 7-27 travels to lock and un-lock the second wing 7-3 from the corner post of the freight container (for this embodiment, the locking pin 7-27 would be of sufficient length to travel through the opening 7-23 of the hinge lug 7-69 and the opening 7-97 in the lower hinge lug 7-67 and the lower seating block 7-63 to lock and un-lock the second wing 7-3 from the corner post of the freight container).

As illustrated in FIG. 7, the lower seating block 7-63 can include a first surface 7-71, on which the lower hinge lug 7-67 seats or rests, a second surface 7-73 substantially perpendicular to the first surface 7-71, and a third surface 7-75 that slopes between the first surface 7-71 and the second surface 7-73 of the lower seating block 7-63. The lower hinge lug 7-67 travels along the third surface 7-75 as the second wing 7-3 pivots around the first hinge pin relative the first wing. The upper seating block 7-65 includes a first surface 7-77, a second surface 7-79 substantially perpendicular to the first surface 7-77, and a third surface 7-81 that slopes between the first surface 7-77 and the second surface 7-79, where the upper hinge lug 7-69 can travels along the third surface 7-81 as the second wing 7-3 pivots around the first hinge pin relative the first wing.

For the various embodiments, the end frame can also include a locking pin travel stop 7-85 to limit a travel distance of the locking pin 7-27. For the various embodiments, the locking pin 7-27 can also include a surface 7-93 defining a structure on which, or into which, a tool can be used to cause the locking pin to travel. For example, the structure can be a notch or a recess formed in the locking pin 7-27 that can accommodate a pry bar or other prying tool that would help in moving the locking pin 7-27. The locking pin 7-27 can secure the hinge 7-44 perpendicular to an axis 7-91 of rotation of the second hinge pin 7-21.

Figure 8:
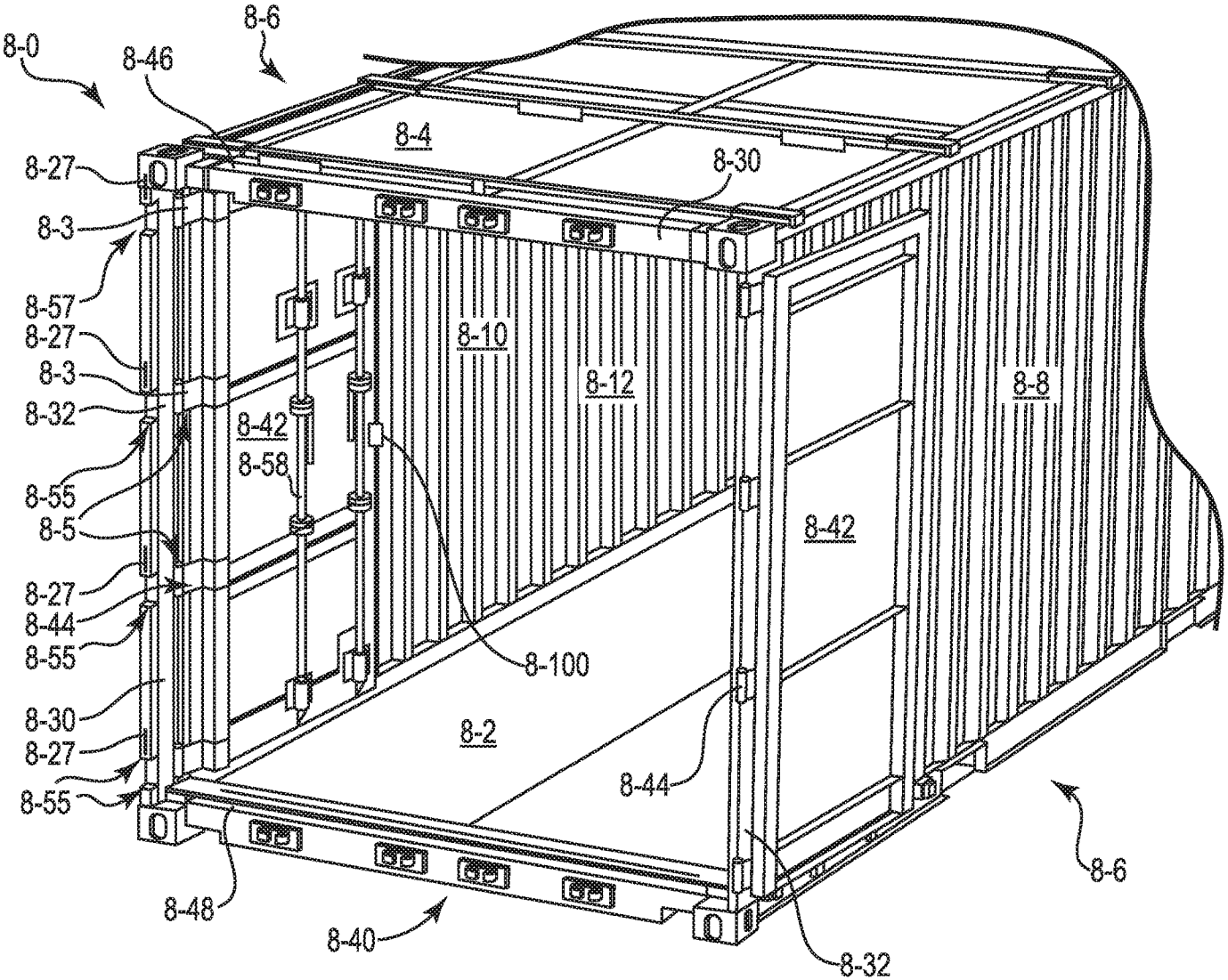
FIG. 8 provides a perspective view of a freight container according to the present disclosure.

Referring now to FIG. 8, there is shown an embodiment of the freight container 8-0 of the present disclosure where one of the door 8-42 is positioned within the volume 8-12 of the freight container 8-0, and the other of the door 8-42 is positioned along the exterior surface 8-8 of the sidewall structures 8-6. As illustrated, the freight container 8-0 includes the roof structure 8-4, the floor structure 8-2 opposite the roof structure 8-4, and the sidewall structures 8-6 between the floor structure 8-2 and the roof structure 8-4, as discussed herein. Each of the sidewall structures 8-6 have the exterior surface 8-8 and the interior surface 8-10, where the interior surface 8-10 at least partially defines the volume 8-12 of the freight container 8-0.

The freight container 8-0 includes the end frame 8-30 joined with the roof structure 8-4, the floor structure 8-2 and the sidewall structures 8-6, where the end frame 8-30 has the door sill 8-48, the door header 8-46 and corner posts 8-32 between the door sill 8-48 and the door header 8-46. The door assembly 8-40 also includes the hinge 8-44 on each of the corner posts 8-32, where the hinge is as discussed herein.

The first wing of the hinge 8-44 is fastened to the corner post 8-32. The first hinge pin 8-5 pivotally connects the first wing fastened to the corner post 8-32 to the second end of the first planar portion of the second wing 8-3, as discussed herein.

The locking pin 8-27 can travel through the at least one of the pair of hinge lugs having the surface defining the opening(s) through which the locking pin travels. The freight container 8-0 further includes the pair of seating blocks 8-55, as discussed herein, fastened to the end frame 8-30 to form the socket 8-57 that receives and seats the hinge lugs of the hinge 8-44. As discussed herein, once the hinge 8-44 is seated on the seating blocks 8-55 in the socket 8-57 the locking pin 8-27 can travel (e.g., be moved up and/or down) to lock and un-lock the second wing of the hinge 8-44 from the corner post 8-32 of the freight container 8-0.

The freight container 8-0 further includes door 8-42 that is joined to the pair of hinge lugs of the hinge 8-44 with the second hinge pin. The door 8-42 pivots on the second hinge pin relative the pair of hinge lugs when the hinge lugs are locked to the corner post 8-32 of the freight container 8-0 to allow the door 8-42 to extend adjacent the exterior surface 8-8 of the sidewall structure 8-6. The door 8-42 and the second wing of the hinge 8-44 can also pivot on the first hinge pin when the hinge lugs are un-locked to the corner post 8-32 of the freight container 8-0 to allow the door 8-42 to travel into the volume 8-12 of the freight container 8-0 and extend adjacent the interior surface 8-10 of the sidewall structure 8-6. Both of these embodiments are illustrated in FIG. 8.

The sidewall structure 8-6 of the freight container 8-0 can further include a latch 8-100, where the latch 8-100 can be used to engage and releasable hold the door 8-42 adjacent the interior surface 8-10 of the sidewall structure 8-6. The door 8-42 is also shown with the locking rod 8-58, as discussed herein, mounted to the door 8-42. As illustrated in FIG. 8, the locking rod 8-58 is shown in the first predetermined position on the door 8-42 positioned along the exterior surface 8-8 of the sidewall structures 8-6 and the second predetermined position on the door 8-42 positioned within the volume 8-12 of the freight container 8-0.

Freight containers can be exposed to a variety of forces when on a ship and/or vehicle. For example, on a ship they can be exposed to movement in six degrees of freedom: rolling, pitching, heaving, swaying, surging and yawing. These motions can impart transverse racking forces on the freight container, especially when they are in a stacked configuration (e.g., fully loaded freight containers stacked ten high). These transverse racking forces can act to distort the walls and the end frames of the container.

Figure 9A:
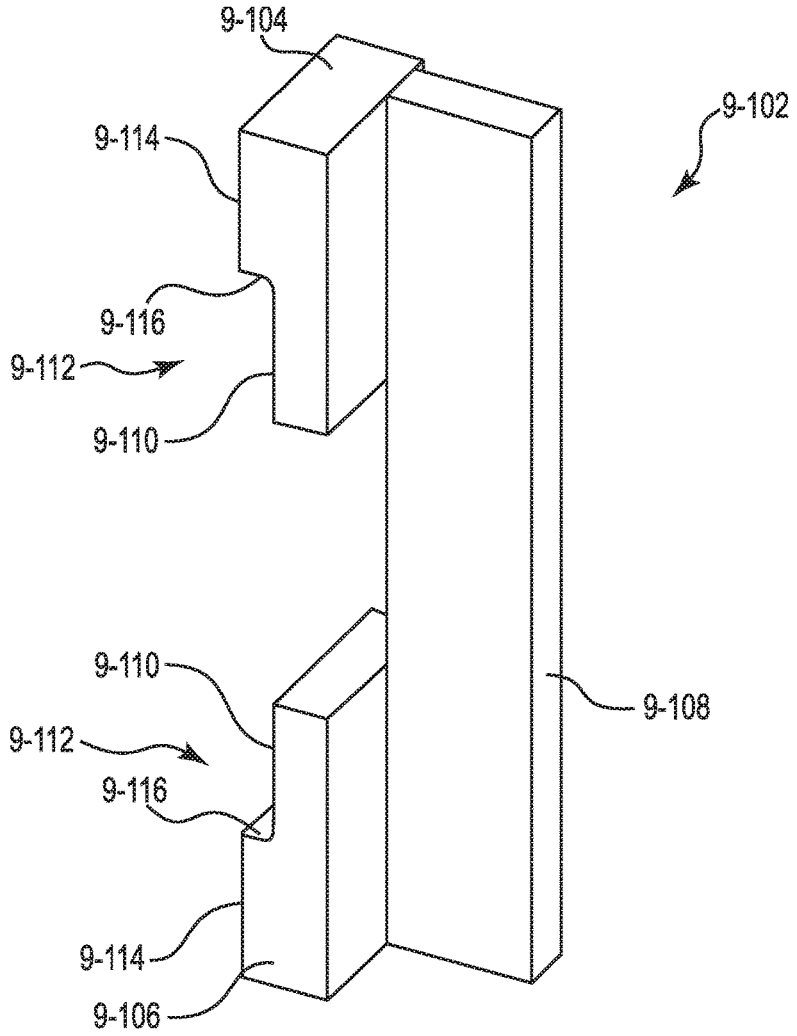
FIGS. 9A-9B provide a perspective view of an anti-racking support according to the present disclosure.
Figure 9B:
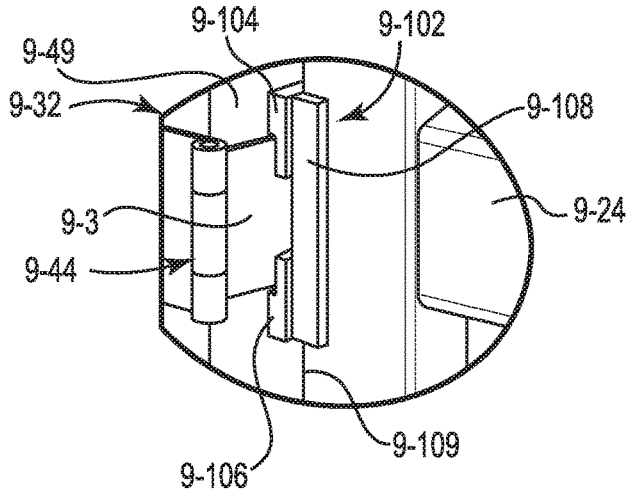
Figure 10A:
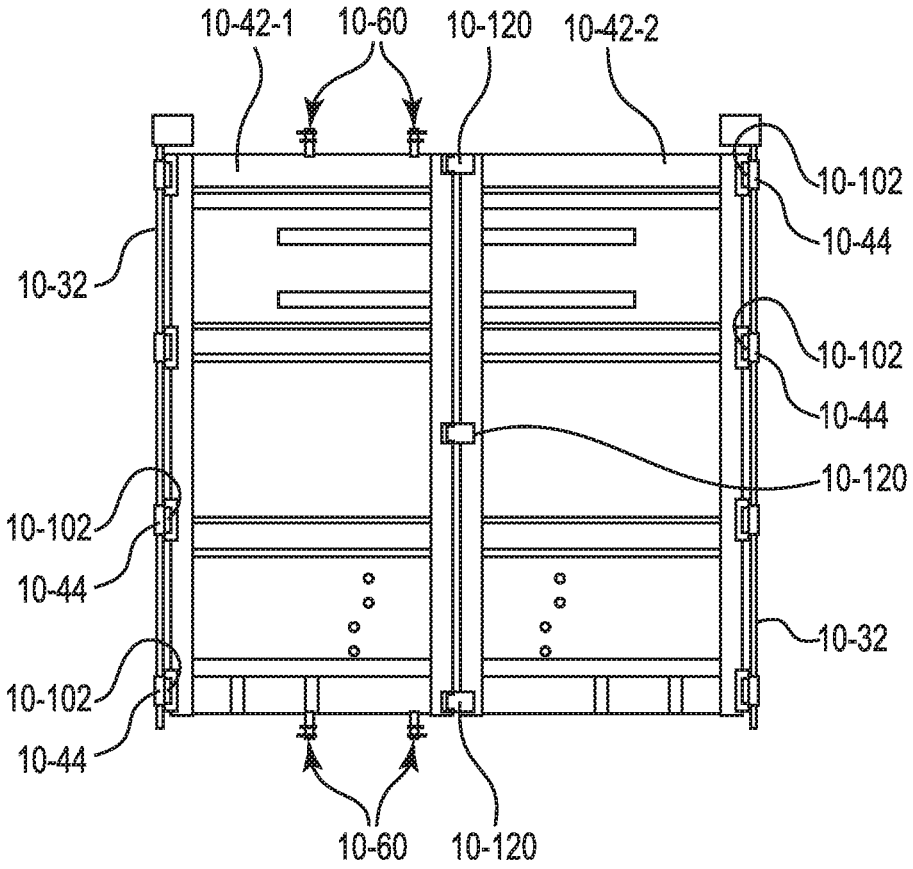
FIGS. 10A-10B provide a perspective view of an anti-racking block for the doors of a freight container according to the present disclosure.

Referring now to FIGS. 9A and 9B, there is shown an anti-racking support 9-102 that can be used with the doors 9-24 of the freight container (to be illustrated more fully herein). The anti-racking support 9-102 includes a first lug 9-104 and a second lug 9-106, both of which extend from a mounting support 9-108 in a common direction. The mounting support 9-108 can have an elongate configuration with a square or rectangular cross-sectional shape (as seen). The mounting support 9-108 can be welded and/or fastened (e.g., bolted or screwed) to the door 9-24 (e.g., an inside surface as illustrated in FIG. 10A) of the freight container to mount the anti-racking support 9-102 in such a way that the first lug 9-104 and the second lug 9-106 of the anti-racking support 9-102 extend from a peripheral edge 9-109 of the door 9-24 of the freight container.

The first lug 9-104 and the second lug 9-106 each have a first surface 9-110 that defines a recess 9-112 relative a second surface 9-114. The first surfaces 9-110 and the second surfaces 9-114 of each of the first lug 9-104 and the second lug 9-106 can be parallel to each other. When mounted to the door 9-24 of the freight container, the recess 9-112 of the first lug 9-104 and the second lug 9-106 can receive and straddle at least a portion of the second wing 9-3 of the hinge 9-44, as provided herein, when the door is in a closed and/or locked (cams of door engaged with the cam keepers) position. The first surface 9-110 of the first lug 9-104 and the second lug 9-106 can also be directly adjacent to (e.g., no intervening structures) and/or make physical contact with the at least a portion of the second wing 9-3 of the hinge when the door is in a closed and/or locked (cams of door engaged with the cam keepers) position. Similarly, the second surface 9-114 of the first lug 9-104 and the second lug 9-106 can also be directly adjacent to and/or make physical contact with the "U"-channel 9-49 of the corner post 9-32 of the freight container when the door is in a closed and/or locked (cams of door engaged with the cam keepers). As a result, the anti-racking support 9-102 can be directly adjacent to and/or in contact with both the hinge 9-44 and the corner post 9-32 when the cam is engaged with the cam keeper.

Each of the first lug 9-104 and the second lug 9-106 also include a third surface 9-116 that extends between the first surface 9-114 and the second surface 9-110. The third surface 9-116 helps to define the recess 9-112. The third surface 9-116 also can be directly adjacent to and/or make physical contact with at least a portion of the second wing 9-3 of the hinge 9-44 when the door 9-24 is in a closed and/or locked (cams of door engaged with the cam keepers) position.

One of the anti-racking support 9-102 can be mounted to the door 9-24 of the freight container relative to each hinge 9-44 (e.g., one anti-racking support 9-102 for each hinge 9-44). When the door 9-24 of the freight container is closed and locked (cams of door engaged with the cam keepers) the anti-racking support 9-102 can help to impede transverse racking of the freight container. For example, the anti-racking support 9-102 can make contact with the U-channel 9-49 during racking so as to help the doors 9-24 keep parallel to the plane of the corner posts. The anti-racking support 9-102 can also help to minimize mechanical stresses on the hinge 9-44 of the door 9-24 of the freight container when it is closed and locked (cams of door engaged with the cam keepers). One way this is accomplished is by the anti-racking support 9-102 making contact with the hinge 9-44 (e.g., the second wing 9-3) and pressing the hinge 9-44 against the U-channel 9-49 so as to keep the hinge 9-44 in its same relative position under non-racking conditions.

The use of the anti-racking support 9-102 on the door 9-24, as discussed herein, helps to limit the impact of racking forces the freight container. When in their closed and locked configuration, the anti-racking support 9-102 and the locking rods help to maintain the relative perpendicular position of the doors 9-24 under racking conditions (e.g., maintain their rectangular shape against the external racking forces). When racking is occurring the anti-racking support 9-102 can provide a "node" through which racking forces (e.g., lateral forces) can be transferred through the doors 9-24. These racking forces can be absorbed through either the anti-racking supports 9-102 on the adjacent door and/or locking rods via the cam, cam keepers and end frame of the freight container. The use of the anti-racking support 9-102 in conjunction with the hinge and freight container of the present discloser can allow a freight container, as provided herein, to meet the requirements of ISO 1496 (fifth edition 1990-08-15) and its amendments.

Figure 10B:
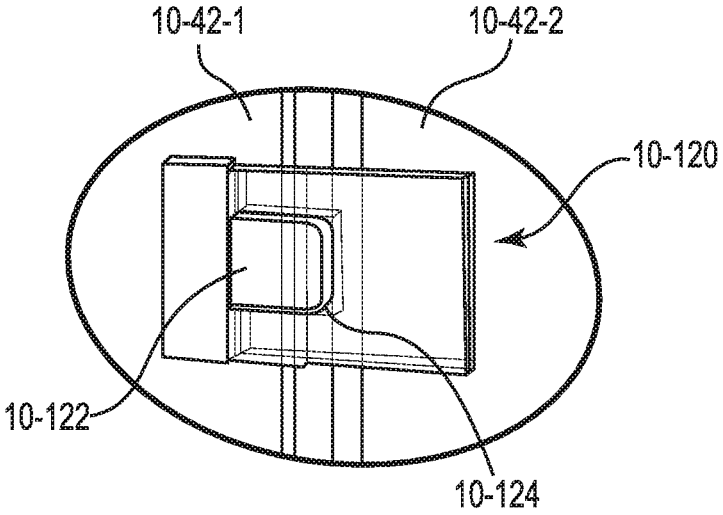

Referring now to FIGS. 10A and 10B there is shown an embodiment of a door 1-42 (as viewed from the "inside" of the freight container) with the anti-racking support 1-102 positioned adjacent the hinge 1-44 mounted to the corner post 1-32. FIGS. 10A and 10B also provide an illustration of an anti-racking block 1-120 mounted to the doors 1-42-1 and 1-42-2. The anti-racking block 1-120 includes a tab 1-122 and a slot 1-124 to releasably receive the tab 1-122. As illustrated, the tab 1-122 extends from the first of the door 1-42-1 and the slot 1-124 extends from the second of the door 1-42-2 such that the tab 1-122 can seat within the slot 1-124 (e.g., completely within the slot 1-124) when the cam 1-60 of each of the first of the door 1-42-1 and the second of the door 1-42-2 are engaged with their respective cam keeper.

The anti-racking block 1-120 helps to limit the impact of racking forces the freight container. The anti-racking block 1-120 also helps to maintain the perpendicular symmetry of the end frame and the doors 1-42 of the freight container during transverse racking. As illustrated, the anti-racking block 1-120 can transfer forces in both the horizontal and vertical planes (e.g., via all three sides of the slot 1-124). This helps to keep the doors 1-42-1 and 1-42-2 in a common plane and helps to maintain the perpendicular symmetry of the end frame and the doors 1-42 of the freight container during transverse racking. This also helps to make the two doors (1-42-1 and 1-42-2) act as one large structure instead of two independent structures.

So, the anti-racking block 1-120 used in conjunction with the anti-racking support 1-102 and the locking rods helps to maintain the relative symmetrical position of the doors 1-42 under racking conditions (e.g., maintain their rectangular shape against the external racking forces). For example, when racking is occurring the anti-racking support 1-102 and the anti-racking block 1-120 can provide the "nodes" through which racking forces (e.g., lateral forces) can be transferred through the doors 1-42. These racking forces can be absorbed through either the anti-racking supports 1-102 on the adjacent door and/or locking rods via the cam, cam keepers and end frame of the freight container.

Figure 11A:
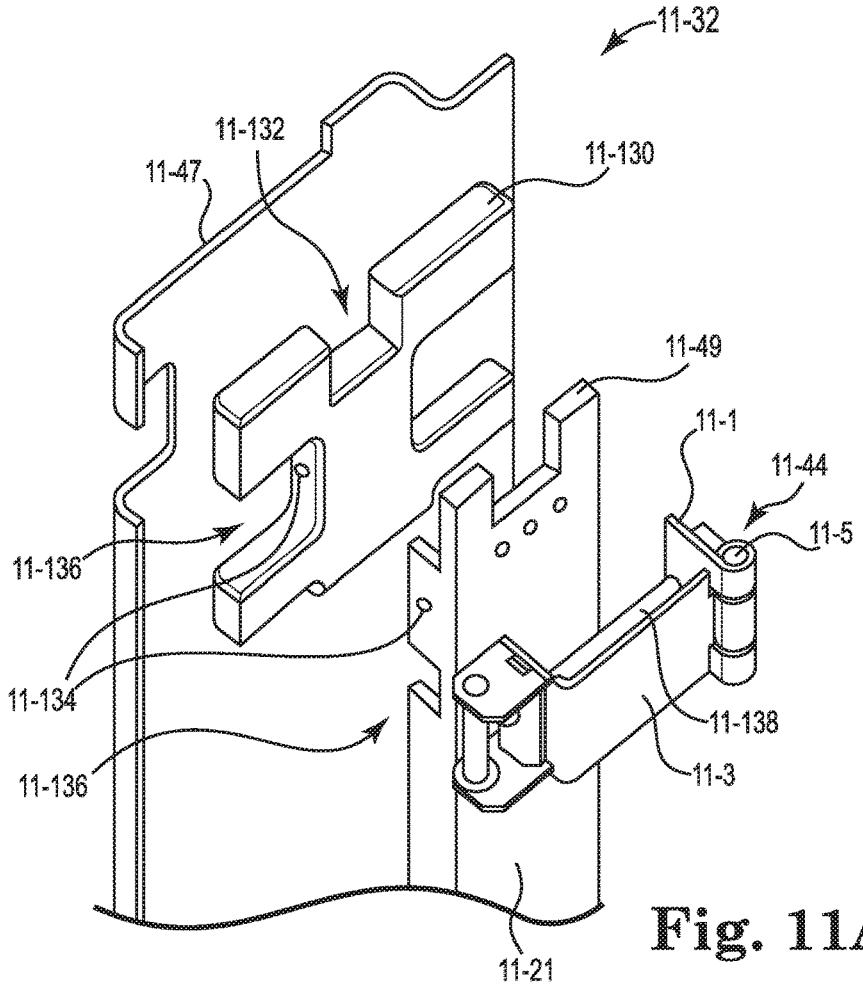
FIGS. 11A-11B provide a perspective view of a hinge for the doors of a freight container according to the present disclosure.
Figure 11B:
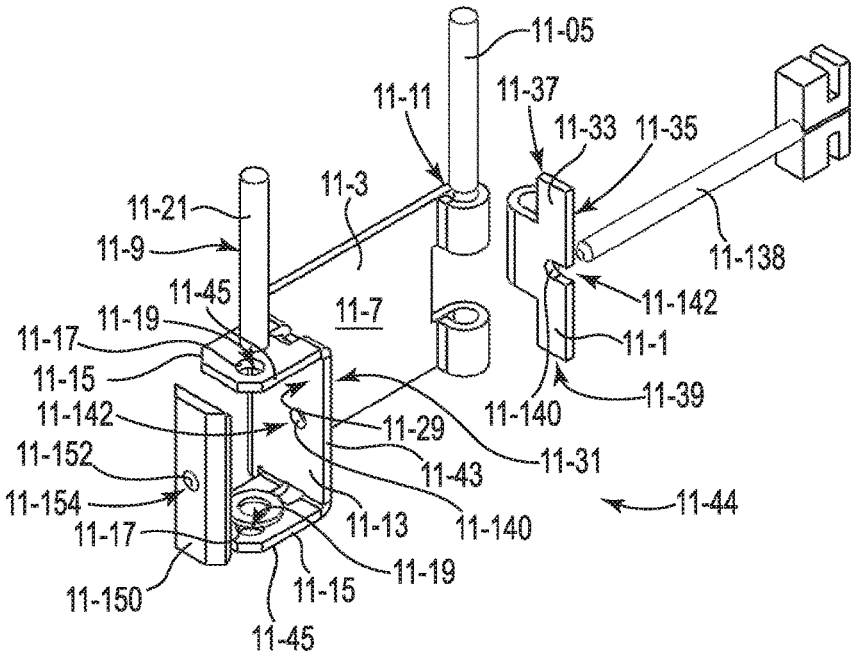

Referring now to FIGS. 11A-11B, there is shown an additional embodiment of the hinge 11-44 and corner post 11-32 of the present disclosure. FIG. 11A shows an exploded partial view of the corner post 11-32, an "H"-Block 11-130 and the hinge 11-44 of the present disclosure. As illustrated, the H-Block 11-130 can be positioned between J-Bar 11-47 and the U-Channel 11-49 of the corner post 11-32. The H-Block 11-130 can be fastened (e.g., welded) to the corner post 11-32. Specifically, the H-Block 11-130 can be welded to the J-Bar 11-47 of the corner post 11-32. To accommodate the H-Block 11-130 portions of the U-Channel 11-49 are removed, where the edges of the U-channel 11-49 can abut and, if desired, be welded to the H-Block 11-130. H-Blocks 11-130 located at the top and bottom of the corner post 11-32 can also be welded directly to the top and bottom corner fittings.

When the hinge 11-44 is secured to the U-channel 11-49, as discussed herein, the H-Block 11-130 can help to protect the hinge 11-44 from forces (e.g., stacking forces) that are transmitted through the corner post 11-32. Specifically, the H-Block 11-130 can help to transmit the forces around the hinge 11-44. The H-Block 11-130 also serves as a seating block for the hinge 11-44 (e.g., the hinge 11-44 can rest in the opening of the H-Block 11-130 on one end and the other end of the H-Block 11-130 provides an open space for a locking pin 11-138, as discussed herein. As such, the H-Block 11-130 can help to protect both the locking pin 11-138 and the hinge 11-44. The H-Block 11-130 also includes notches 11-132 that extend in from the legs of the "H," where these notches 11-132 help to relieve stresses formed when the freight container is stacked (confirmed by Finite Element Analysis modeling).

Both the U-Channel 11-49 and the H-Block 11-130 also include a surface 11-134 that defines a hole 11-136 through the U-Channel 11-49 and the H-Block 11-130. The hole 11-136 is sized to receive and reversibly pass at least a portion of a locking pin 11-138. The locking pin 11-138 is used to releasably lock the second wing 11-3 of the hinge 11-44 to both the corner post 11-32 and the H-Block 11-130. The locking pin 11-138 is manipulated from the inside of the freight container.

For the various embodiments, the locking pin 11-138 can be positioned through the hole 11-136 so as to releasably lock the second wing 11-3 of the hinge 11-44 to both the corner post 11-32 and the H-Block 11-130, and removed from the hole 11-136 so as to unlock the second wing 11-3 of the hinge 11-44 from both the corner post 11-32 and the H-Block 11-130. Specifically, the locking pin 11-138 can be retracted into the hole 11-136 so as to release the second wing 11-3 of the hinge 11-44 from the corner post 11-32 and the H-Block 11-130. Once released, the second wing 11-3 can rotate around first hinge pin 11-5. To lock the second wing 11-3 to the corner post 11-32 and the H-Block 11-130, the locking pin 11-138 is aligned and reinserted though the hole 11-136 of the corner post 11-32 and the H-Block 11-130. As discussed herein, the first wing 11-1 can be fastened to the portion of the U channel 11-49 and the H-Block 11-130 by a welding (e.g., arc-welding) process.

FIG. 11B provides an exploded view of the hinge 11-44. As illustrated, the hinge 11-44 includes the first wing 11-1 and the second wing 11-3, where the first wing 11-1 and the second wing 11-3 are pivotally connected by the first hinge pin 11-5. For the various embodiments, the second wing 11-3 includes the first planar portion 11-7 with the first end 11-9 and the second end 11-11 and the second planar portion 11-13 that extends perpendicular from the first end 11-9 of the first planar portion 11-7. The first hinge pin 11-5 pivotally connects the first wing 11-1 to the second end 11-11 of the first planar portion 11-7. As illustrated, a portion of the first planar portion 11-7 of the second wing 11-3 passes through an opening defined in the first wing 11-1 so as to allow the second end 11-11 of the first planar portion 11-7 of the second wing 11-3 to pivotally connect to the first hinge pin 11-5 and the first wing 11-1.

The hinge 11-44 also includes a pair of hinge lugs 11-15 that extend from the second planar portion 11-13 of the second wing 11-3. Each of the hinge lugs 11-15 has a first set of surfaces 11-17 defining openings 11-19 through which the second hinge pin 11-21 passes. For the various embodiments, the first wing 11-1 and the second planar portion 11-13 of the second wing 11-3 include a surface 11-140 that defines an opening 11-142 through which the locking pin 11-138 reversibly travels.

The second planar portion 11-13 of the second wing 11-3 includes the first major surface 11-29 and the second major surface 11-31 opposite the first major surface 11-29. The pair of hinge lugs 11-15 extends from the first major surface 11-29 of the second planar portion 11-13. The first wing 11-1 has the first major surface 11-33 and the second major surface 11-35 opposite the first major surface 11-33. In a first predetermined position the first wing 11-1 is perpendicular to the first planar portion 11-7 of the second wing 11-3 and the first major surface 11-33 of the first wing 11-1 is directly opposite and parallel with the second major surface 11-31 of the second planar portion 11-13. As discussed herein, the first predetermined position can occur with the first wing 11-1 attached to the corner post 11-32 of the freight container and the second wing 11-3 of the hinge 11-44 positioned against (e.g., adjacent to and in at least partial contact with) the corner post.

The first wing 11-1 has a first end 11-37 and a second end 11-39. The first hinge pin 11-5 pivotally connects the first end 11-37 of the first wing 11-1 to the second end 11-11 of the first planar portion 11-7 of the second wing 11-3. The second planar portion 11-13 has an end 11-43 that is distal to the first end 11-9 of the first planar portion 11-7 and the pair of hinge lugs 11-15 extending from the second planar portion 11-13 have a first peripheral edge 11-45, where the end 11-43 of the second planar portion 11-13 and the first peripheral edge 11-45 of the hinge lugs 11-15 lay in a common plane.

The hinge 11-44 further includes a support block 11-150. Support block includes a surface 11-152 that defines an opening 11-154. Support block 11-150 can be positioned against the second planar portion 11-13 of the second wing 11-3, where the opening 11-154 concentrically aligns with the opening 11-142 through which the locking pin 11-138 travels. Support block 11-150 can be welded to the second planar portion 11-13 of the second wing 11-3. Support block 11-150 can also be chamfered so as to allow the door of the freight container to swing unencumbered.

For the various embodiments, the components of the freight container provided herein can be formed of materials suitable for and built so as to comply with ISO standard 1496-1 (fifth edition 1990-08-15) and its amendments, which are all incorporated herein by reference in its entirety. For the various embodiments, the components of the freight container can be formed of steel. Examples of such steel include, but are not limited to, 'weathering steel' as specified within standard BS EN 10025-5:2004, which is also known as CORTEN steel. For the various embodiments, the floor of the freight container can be made of planking wood or plywood.

Although specific examples have been illustrated and described herein, those of ordinary skill in the art will appreciate that an arrangement calculated to achieve the same results can be substituted for the specific examples shown. This disclosure is intended to cover adaptations or variations of one or more examples of the present disclosure. It is to be understood that the above description has been made in an illustrative fashion, and not a restrictive one. Combination of the above examples, and other examples not specifically described herein will be apparent to those of skill in the art upon reviewing the above description. For example, the door assembly of the present disclosure could be used at both ends of the freight container. The scope of the one or more examples of the present disclosure includes other applications in which the above structures and methods are used. Therefore, the scope of one or more examples of the present disclosure should be determined with reference to the appended claims, along with the full range of equivalents to which such claims are entitled.

In Detailed Description, some features are grouped together in a single embodiment for the purpose of streamlining the disclosure. This method of disclosure is not to be interpreted as reflecting an intention that the disclosed examples of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A freight container, comprising:

a roof structure;

a floor structure opposite the roof structure;

sidewall structures between the floor structure and the roof structure;

an end frame having a corner post, the end frame joined with the roof structure, the floor structure and the sidewall structures;

a door joined to the corner post with a hinge, the hinge having a locking pin, a first wing, a first hinge pin, a second hinge pin, and a second wing, where the first wing is fastened to the corner post, the second wing has a first planar portion with a first end and a second end and a second planar portion that extends perpendicular from the first end of the first planar portion, where the first hinge pin pivotally connects the first wing fastened to the corner post to the second end of the first planar portion;

a pair of hinge lugs extending from the second planar portion, the hinge lugs each having a first set of surfaces defining openings through which the second hinge pin passes, where the door pivots on the second hinge pin relative the pair of hinge lugs when the hinge lugs are locked to the corner post of the freight container with the locking pin to allow the door to extend adjacent the exterior surface of the sidewall structure, and where the door and the second wing pivot on the first hinge pin when the hinge lugs are un-locked to the corner post of the freight container to allow the door to travel into the volume of the freight container and extend adjacent the interior surface of the sidewall structure; and an anti-racking support including a first lug, a second lug and a mounting support fastened to the door, where the first lug and the second lug extend from the mounting support in a common direction to extend from a peripheral edge of the door.

2. The freight container of claim 1, where each of the first lug and the second lug has a first surface and a second surface parallel with each other, where the first surface defines a recess relative the second surface.

3. The freight container of claim 2, where the recess defined by the first lug and the second lug receives and straddles at least a portion of the second wing of the hinge when the door is in a closed position.

4. The freight container of claim 1, where the second surface of the first lug and the second lug make physical contact with the corner post of the freight container when the door is in a closed position.

5. The freight container of claim 1, where each of the first lug and the second lug has a third surface that makes physical contact with at least a portion of the second wing of the hinge when the door is in a closed position.

6. The freight container of claim 1, further including an anti-racking block mounted to the door, where the anti-racking block includes a tab and a slot to releasably receive the tab.

7. The freight container of claim 6, where the use of the tab and the slot help maintain a perpendicular symmetry of the end frame and the doors of the freight container during transverse racking.

* * * * *